US011074886B2

(12) United States Patent
Zheng

(10) Patent No.: US 11,074,886 B2
(45) Date of Patent: Jul. 27, 2021

(54) MULTIPLEXING CIRCUIT

(71) Applicant: WUHAN CHINA STAR OPTOELECTRONICS TECHNOLOGY CO., LTD., Hubei (CN)

(72) Inventor: Lihua Zheng, Hubei (CN)

(73) Assignee: Wuhan China Star Optoelectronics Technology Co., Ltd., Hubei (CN)

( * ) Notice: Subject to any disclaimer, the term of this patent is extended or adjusted under 35 U.S.C. 154(b) by 0 days.

(21) Appl. No.: 16/488,941

(22) PCT Filed: May 22, 2019

(86) PCT No.: PCT/CN2019/088004
§ 371 (c)(1),
(2) Date: Aug. 27, 2019

(87) PCT Pub. No.: WO2020/199326
PCT Pub. Date: Oct. 8, 2020

(65) Prior Publication Data

US 2020/0335059 A1 Oct. 22, 2020

(30) Foreign Application Priority Data

Apr. 3, 2019 (CN) ..... 201910264035.9

(51) Int. Cl.
*G09G 5/00* (2006.01)

(52) U.S. Cl.
CPC ..... *G09G 5/006* (2013.01); *G09G 2310/0297* (2013.01); *G09G 2310/08* (2013.01)

(58) Field of Classification Search
CPC combination set(s) only.
See application file for complete search history.

(56) References Cited

U.S. PATENT DOCUMENTS

2007/0057877 A1* 3/2007 Choi ..... G09G 3/3291 345/76
2014/0035896 A1 2/2014 Lin et al.
2014/0092076 A1* 4/2014 Lee ..... G09G 3/3291 345/212

(Continued)

FOREIGN PATENT DOCUMENTS

CN 103226928 A 7/2013
CN 103366701 A 10/2013

(Continued)

*Primary Examiner* — Krishna P Neupane
(74) *Attorney, Agent, or Firm* — Mark M. Friedman

(57) ABSTRACT

A multiplexing circuit is provided. The multiplexing circuit includes a first multiplexing unit. The first multiplexing unit is configured to receive a signal at a first output end of a source driving circuit of a display and configured to transmit the signal to a pixel of the display. The first multiplexing unit includes a first switching unit configured to control transmitting of the signal to a first sub-pixel of a first pixel of the display. The first switching unit includes a first switch and a second switch. Both the first switch and the second switch are electrically connected between the first output end and the first sub-pixel of the first pixel. The first switch and the second switch are configured to simultaneously turn on or turn on only one to transmit the signal to the first sub-pixel of the first pixel.

18 Claims, 20 Drawing Sheets

(56) References Cited

U.S. PATENT DOCUMENTS

| | | | | |
|---|---|---|---|---|
| 2014/0267218 | A1* | 9/2014 | Pai | G09G 3/20 345/214 |
| 2015/0255030 | A1 | 9/2015 | Watsuda et al. | |
| 2017/0243559 | A1* | 8/2017 | Xi | G09G 3/3614 |
| 2017/0345384 | A1 | 11/2017 | Ma et al. | |
| 2018/0047353 | A1 | 2/2018 | Lin | |
| 2018/0293943 | A1 | 10/2018 | Hong et al. | |
| 2019/0147786 | A1* | 5/2019 | Kim | H01L 27/14609 345/690 |

FOREIGN PATENT DOCUMENTS

| | | | |
|---|---|---|---|
| CN | 105469765 | A | 4/2016 |
| CN | 105810173 | A | 7/2016 |
| CN | 106935217 | A | 7/2017 |
| CN | 108877637 | A | 11/2018 |

* cited by examiner

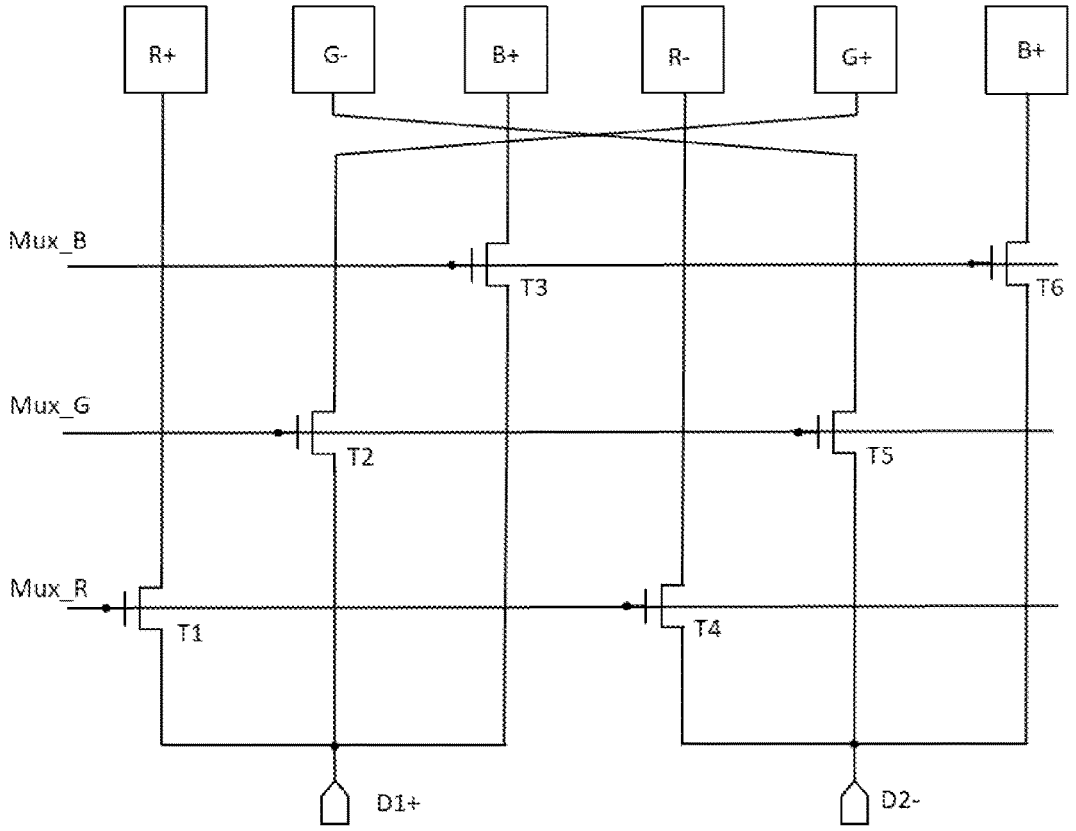
FIG. 1 --Prior Art--
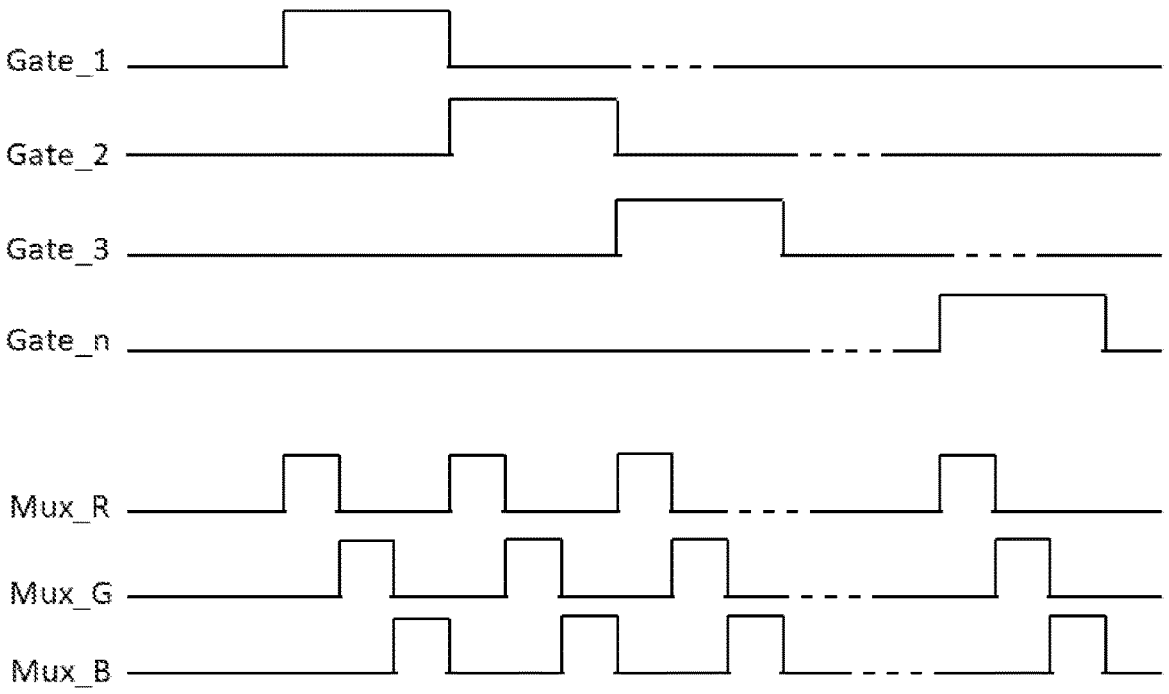
FIG. 2 –Prior Art--

MULTIPLEXING CIRCUIT

FIELD OF INVENTION

The present disclosure relates to display technologies, and more particularly, to a multiplexing circuit.

BACKGROUND OF INVENTION

A current frame rate of a display is generally 60 Hz, that is, a screen of the display is refreshed 60 times per second, so that images seen by the human is dynamic and smooth. In some application scenarios, such as standby, in order to save power consumption of the display, the frame rate of the display needs to be reduced. For example, the frame rate is reduced from 60 Hz to 30 Hz. In other scenarios, such as displaying animations, the frame rate of the display needs to be increased. For example, the frame rate is increased from 60 HZ to 90 HZ or 120 HZ, which makes the image smoother. Therefore, a dynamic frame rate display technique is proposed to change the display frame rate in different scenes.

In addition, existing displays typically use one-to-one multiplexing or one-to-three multiplexing techniques. Referring to FIGS. 1 and 2, the one-to-three multiplexing technique is a technique for charging three sub-pixels by a data line under the principle of time division multiplexing.

For the same screen, compared to the one-to-one multiplexing technology, the use of the one-to-three multiplexing technology can reduce the two-thirds source line trace, reduce fanout space of the source line, and thus reduce a bottom border of the display screen to achieve a narrow bezel design.

According to the existing design of a drive circuit, a value of width to length ratio of a transistor channel in a multiplex circuit of the low frame rate display is usually designed to be small. In order achieve high frame rate displaying, the value of the width to length ratio of the transistor channel in the multiplex circuit must be changed to a large design. But this will instead cause the low frame rate display to flicker and consume more power.

Therefore, prior art has drawbacks and is in urgent need of improvement.

SUMMARY OF INVENTION

In view of the above, the present disclosure provides a touch panel, a touch display and a method of manufacturing the touch panel to solve the aforementioned issues.

In order to achieve above-mentioned object of the present disclosure, one embodiment of the disclosure provides a multiplexing circuit including a first multiplexing unit, a first control line, and a second control line. The first multiplexing unit is configured to receive a signal at a first output end of a source driving circuit of a display and configured to transmit the signal to a pixel of the display. The first multiplexing unit includes a first switching unit configured to control transmitting of the signal to a first sub-pixel of a first pixel of the display. The first switching unit includes a first switch and a second switch. Both the first switch and the second switch are electrically connected between the first output end and the first sub-pixel of the first pixel. The first control line is electrically connected to the first switch to control the first switch turning on or off, and the second control line is electrically connected to the second switch to control the second switch turning on or off. The first switch and the second switch are configured to simultaneously turn on or turn on only one to transmit the signal to the first sub-pixel of the first pixel.

In one embodiment of the multiplexing circuit, the first switching unit further includes a first selecting switch electrically connected between the first control line and the second control line to control the second switch turning on or off. The multiplexing circuit further includes a first selecting signal line configured to control the first selecting switch turning on or off.

In one embodiment of the disclosure, the multiplexing circuit further includes a first selecting switch electrically connected between the first control line and the second control line to control the second switch turning on or off. The multiplexing circuit further includes a first selecting signal line configured to control the first selecting switch turning on or off.

In one embodiment of the disclosure, the multiplexing circuit further includes a second multiplexing unit configured to receive a signal at a second output end of the source driving circuit of the display and configured to transmit the signal to the pixel of the display. The second multiplexing unit includes a first switching unit configured to control transmitting of the signal to a first sub-pixel of a second pixel of the display. The first switching unit of the second multiplexing unit includes a first switch and a second switch. Both the first switch of the second multiplexing unit and the second switch of the second multiplexing unit are electrically connected between the first output end and the first sub-pixel of the second pixel. The first selecting switch is electrically connected to the second switch of the second multiplexing unit to control the second switch of the second multiplexing unit turning on or off.

In one embodiment of the multiplexing circuit, the first switching unit further includes a third switch. The third switch is electrically connected between the first output end and the first sub-pixel of the first pixel. The first switch, the second switch, and the third switch are configured to simultaneously turn on, turn on the first switch and the second switch only, or turn on the first switch only to transmit the signal to the first sub-pixel of the first pixel.

In one embodiment of the disclosure, the multiplexing circuit further includes a third control line electrically connected to the third switch to control the third switch turning on or off.

In one embodiment of the multiplexing circuit, the first switching unit further includes a first selecting switch and a second selecting switch. The first selecting switch is electrically connected between the first control line and the second control line to control the second switch turning on or off. The second selecting switch is electrically connected between the first control line and the third control line to control the third switch turning on or off. The multiplexing circuit further includes a first selecting signal line and a second selecting signal line. The first selecting signal line is configured to control the first selecting switch turning on or off, and the second selecting signal line is configured to control the second selecting switch turning on or off.

In one embodiment of the disclosure, the multiplexing circuit further includes a first selecting switch and a second selecting switch. The first selecting switch is electrically connected between the first control line and the second control line to control the second switch turning on or off. The second selecting switch is electrically connected between the first control line and the third control line to control the third switch turning on or off. The multiplexing circuit further includes a first selecting signal line and a second selecting signal line. The first selecting signal line is configured to control the first selecting switch turning on or off, and the second selecting signal line is configured to control the second selecting switch turning on or off.

In one embodiment of the disclosure, the multiplexing circuit further includes second multiplexing unit configured to receive a signal at a second output end of the source driving circuit of the display and configured to transmit the signal to the pixel of the display. The second multiplexing unit includes a first switching unit configured to control transmitting of the signal to a first sub-pixel of a second pixel of the display. The first switching unit of the second multiplexing unit includes a first switch, a second switch, and a third switch. All the first switch of the second multiplexing unit, the second switch of the second multiplexing unit, and the third switch of the second multiplexing unit are electrically connected between the first output end and the first sub-pixel of the second pixel. The first selecting switch is electrically connected to the second switch of the second multiplexing unit to control the second switch of the second multiplexing unit turning on or off. The second selecting switch is electrically connected to the third switch of the second multiplexing unit to control the third switch of the second multiplexing unit turning on or off.

In one embodiment of the multiplexing circuit, the first multiplexing unit further includes a second switching unit and a third switching unit. The second switching unit is configured to control transmitting of the signal to a second sub-pixel of the first pixel. The third switching unit is configured to control transmitting of the signal to a third sub-pixel of the first pixel. Both the second switching unit and the third switching unit includes two switches. Both a first switch of the second switching unit and a second switch of the second switching unit are electrically connected between the first output end and the second sub-pixel of the first pixel. The first switch of the second switching unit and the second switch of the second switching unit are configured to simultaneously turn on or turn on only one to transmit the signal to the second sub-pixel of the first pixel. Both a first switch of the third switching unit and a second switch of the third switching unit are electrically connected between the first output end and the third sub-pixel of the first pixel. The first switch of the third switching unit and the second switch of the third switching unit are configured to simultaneously turn on or turn on only one to transmit the signal to the third sub-pixel of the first pixel.

In comparison with the prior art, one embodiment of the disclosure provides the multiplexing circuit with every switching unit having at least two controllable switches to simultaneously turn on or turn on only one to transmit the signal to a sub-pixel. A display device can select appropriate width to length ratio of transistor channel at different frame rates to improve display quality of images and to consume less power without causing low-frequency flickering of the images.

BRIEF DESCRIPTION OF DRAWINGS

FIG. 1 is a schematic view of a structure of a multiplexing circuit according to prior art.

FIG. 2 is a signal timing schematic diagram of the multiplexing circuit according to FIG. 1.

DETAILED DESCRIPTION OF PREFERRED EMBODIMENTS

The following description of the embodiments is provided by reference to the following drawings and illustrates the specific embodiments of the present disclosure. Directional terms mentioned in the present disclosure, such as "up," "down," "top," "bottom," "forward," "backward," "left," "right," "inside," "outside," "side," "peripheral," "central,"

"horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 3:
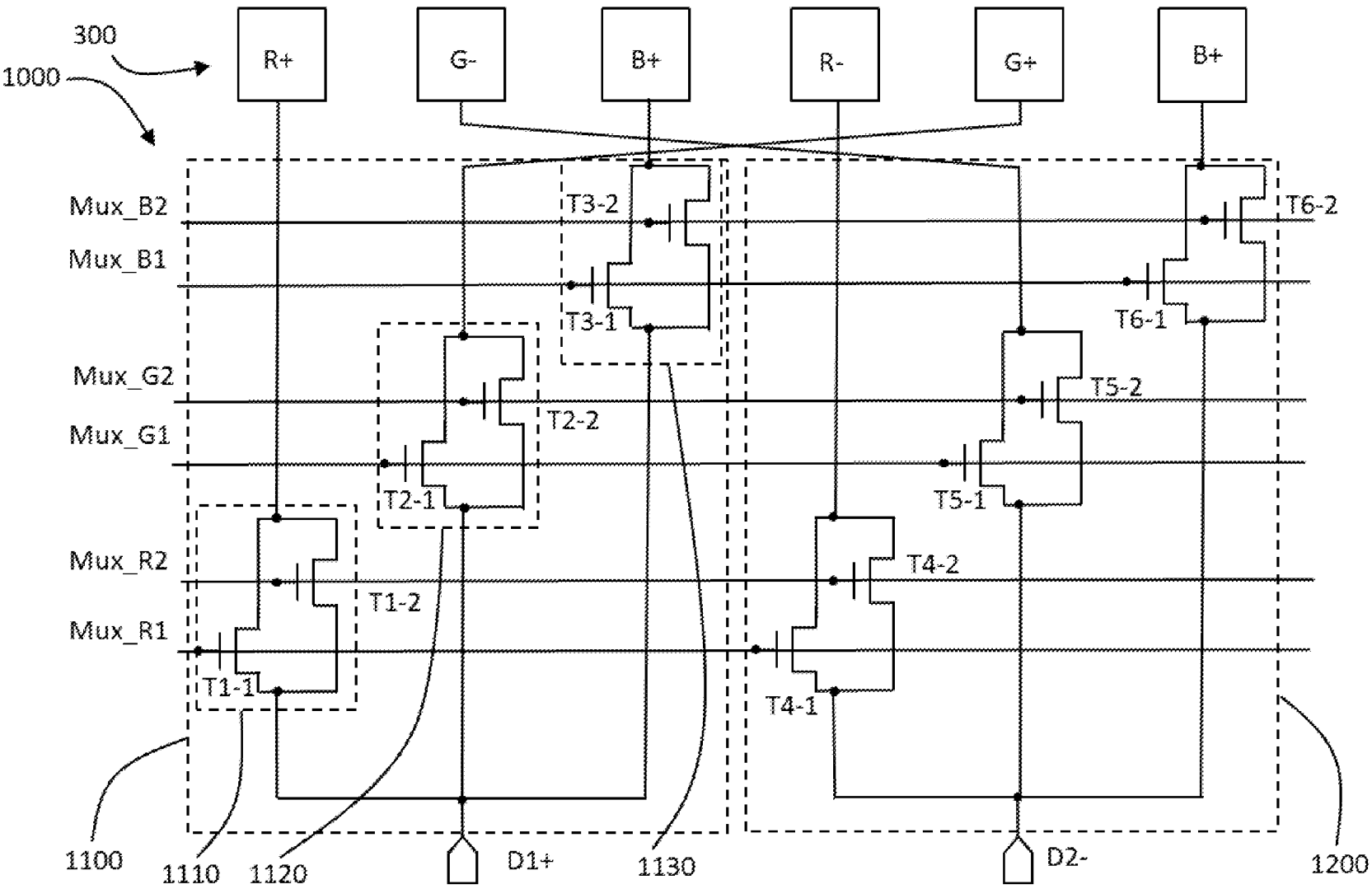
FIG. 3 is a schematic view of a structure of a multiplexing circuit according to an embodiment of the present disclosure.

Referring to FIG. 3, one embodiment of the disclosure provides a multiplexing circuit 1000 including a first multiplexing unit 1100, a first control line Mux_R1, and a second control line Mux_R2. The first multiplexing unit 1100 is configured to receive a signal at a first output end D1+ of a source driving circuit of a display and configured to transmit the signal to a pixel 300 of the display. The first multiplexing unit 1100 includes a first switching unit 1110 configured to control transmitting of the signal to a first sub-pixel R+ of a first pixel of the display. The first switching unit 1110 includes a first switch T1-1 and a second switch T1-2. Both the first switch T1-1 and the second switch T1-2 are electrically connected between the first output end D1+ and the first sub-pixel of the first pixel R+. The first control line Mux_R1 is electrically connected to the first switch T1-1 to control the first switch T1-1 turning on or off, and the second control line Mux_R2 is electrically connected to the second switch T1-2 to control the second switch T1-2 turning on or off. The first switch T1-1 and the second switch T1-2 are configured to simultaneously turn on, turn on only the first switch T1-1, or turn on only the second switch T1-2 to transmit the signal to the first sub-pixel R+ of the first pixel.

Referring to FIG. 3, in one embodiment of the multiplexing circuit 1000, the first multiplexing unit 1100 further includes a second switching unit 1120 and a third switching unit 1130. The second switching unit 1120 is configured to control transmitting of the signal to a second sub-pixel G− of the display. The third switching unit 1130 is configured to control transmitting of the signal to a third sub-pixel B+ of the display. Both the second switching unit 1120 and the third switching unit 1130 includes two switches. Both a first switch T2-1 of the second switching unit 1120 and a second switch T2-2 of the second switching unit 1120 are electrically connected between the first output end D+ and the second sub-pixel G−. The first switch T2-1 of the second switching unit 1120 and the second switch T2-2 of the second switching unit 1120 are configured to simultaneously turn on or turn on only one to transmit the signal to the second sub-pixel G−. Both a first switch T3-1 of the third switching unit 1130 and a second switch T3-2 of the third switching unit 1130 are electrically connected between the first output end D1+ and the third sub-pixel B+. The first switch T3-1 of the third switching unit 1130 and the second switch T3-2 of the third switching unit 1130 are configured to simultaneously turn on or turn on only one to transmit the signal to the third sub-pixel B+.

In detail, a third control line Mux_G1 electrically connected to the first switch T2-1 of the second switching unit 1120 to control the first switch T2-1 turning on or off. A fourth control line Mux_G2 electrically connected to the second switch T2-2 of the second switching unit 1120 to control the second switch T2-2 turning on or off. A fifth control line Mux_B1 electrically connected to the first switch T3-1 of the third switching unit 1130 to control the first switch T3-1 turning on or off. A sixth control line Mux_B2 electrically connected to the second switch T3-2 of the third switching unit 1130 to control the second switch T3-2 turning on or off.

In detail, a second multiplexing unit 1200 is similar to the first multiplexing unit 1100. The second multiplexing unit 1200 includes three switching units corresponding to different sub-pixels respectively. Each switching unit includes two switches.

In one embodiment of the multiplexing circuit 1000, a signal at the first output end D1+ is opposite to a signal at a second output end D2−. In detail, this arrangement can reduce crosstalk between signals, but the disclosure is not limit about it.

In detail, the first sub-pixel R+ of the first pixel is red sub-pixel. The second sub-pixel G− of the first pixel is green sub-pixel. The third sub-pixel B+ of the first pixel is blue sub-pixel, but the disclosure is not limit about it. Arrangement of the sub-pixels, number of the sub-pixel, and color of the sub-pixel may be modified base on real application.

In detail, a signal of the first sub-pixel R+ and a signal of the second sub-pixel G− are opposite. The signal of the second sub-pixel G− and a signal of the third sub-pixel B+ are opposite. This arrangement can reduce crosstalk between signals, but the disclosure is not limit about it.

In detail, the switch is P channel metal oxide semiconductor field effect transistor (MOSFET), N channel MOSFET, or thin film transistor, for example. The disclosure is not limit about it.

In detail, numbers of the sub-pixels and numbers of the multiplexing units are merely examples, and the disclosure is not limited thereto.

Figure 4:
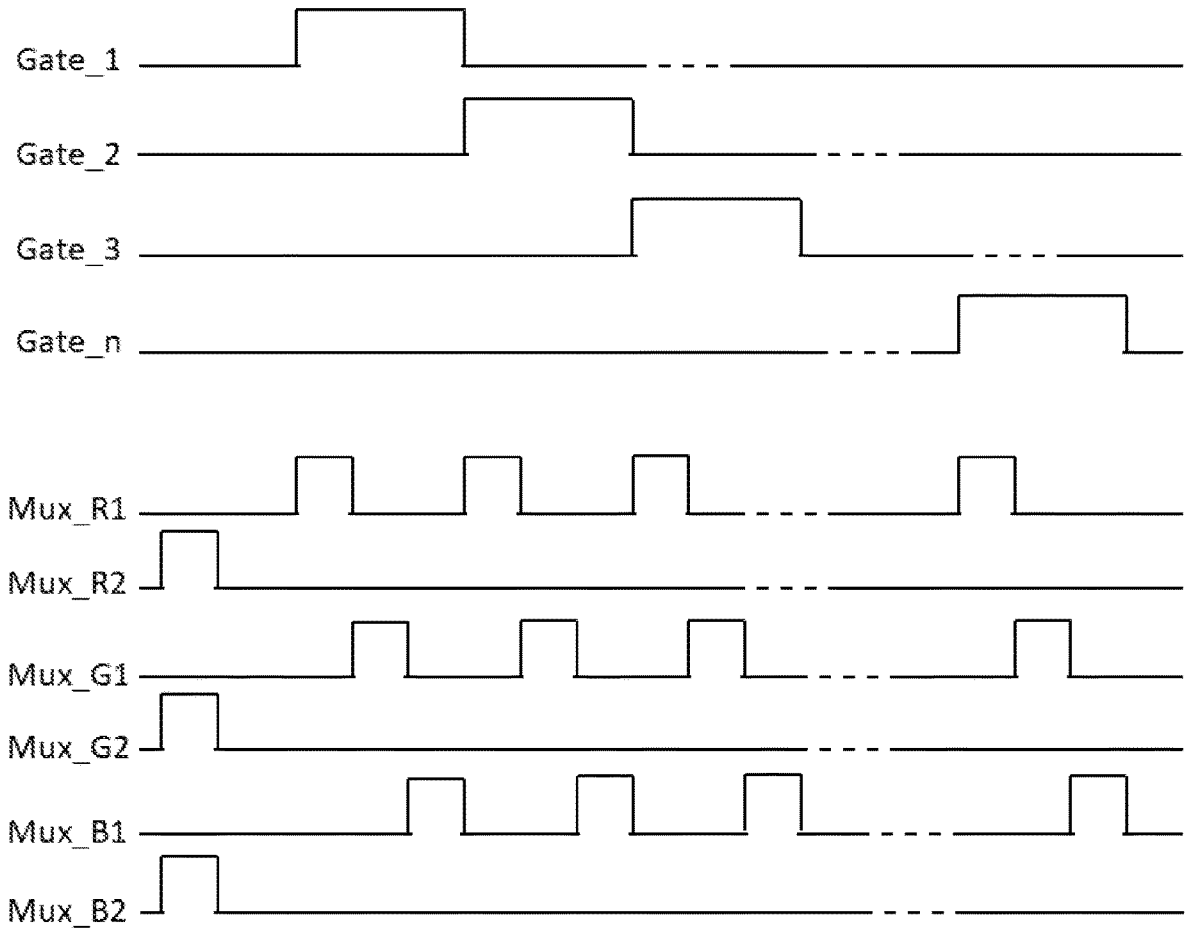
FIG. 4 is a signal timing schematic diagram of the multiplexing circuit according to the embodiment of FIG. 3 of the present disclosure.

Referring to FIG. 4, in detail, the multiplexing circuit provides signal in means of that shown in FIG. 4 that only one switch in each switching unit is turning on when the display device needs less width to length ratio of transistor channel to achieve an advantage of less power consumption without low-frequency flickering.

Figure 5:
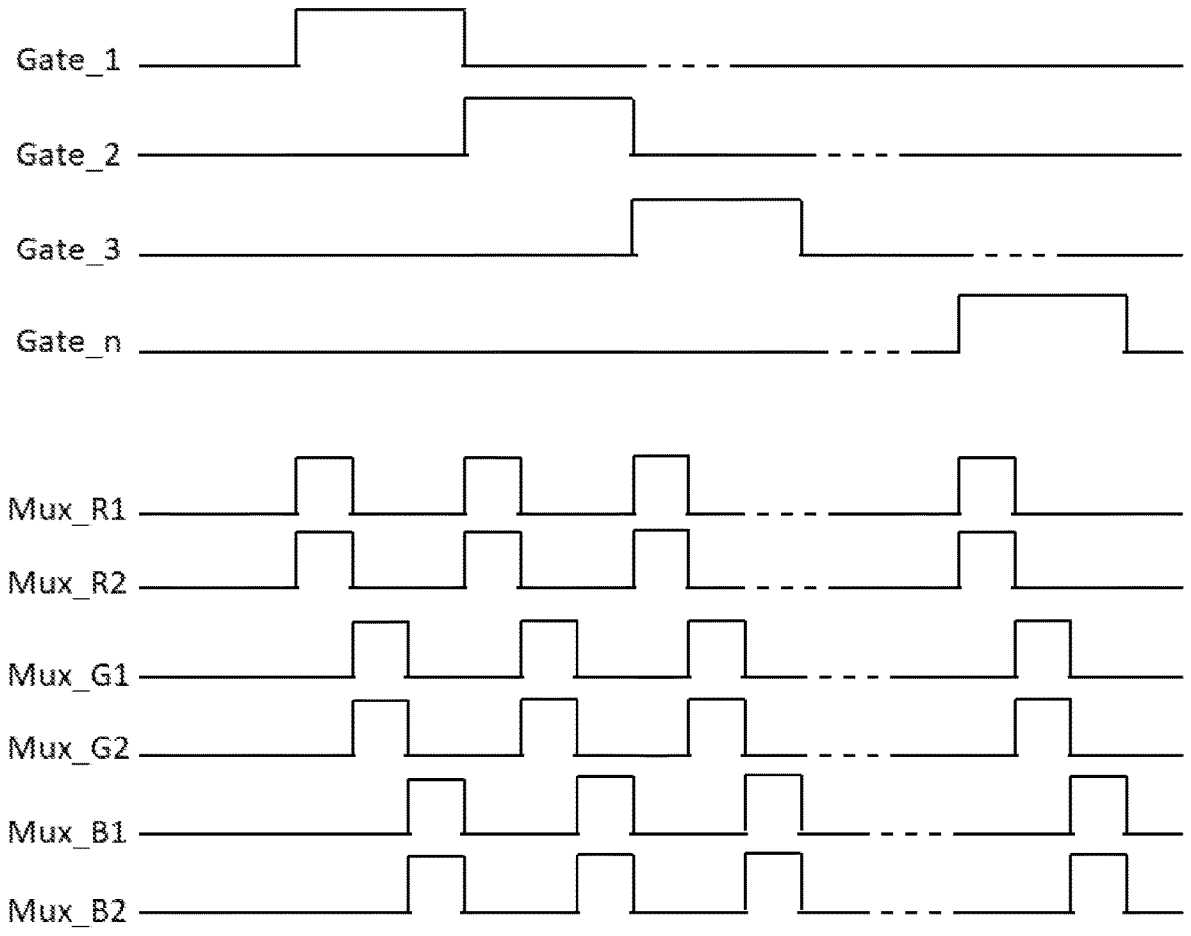
FIG. 5 is a signal timing schematic diagram of the multiplexing circuit according to another embodiment of FIG. 3 of the present disclosure.

Referring to FIG. 5, in detail, the multiplexing circuit provides signal in means of that shown in FIG. 5 that two switches in each switching unit are turning on when the display device needs much width to length ratio of transistor channel to provide greater equivalent width to length ratio.

Figure 6:
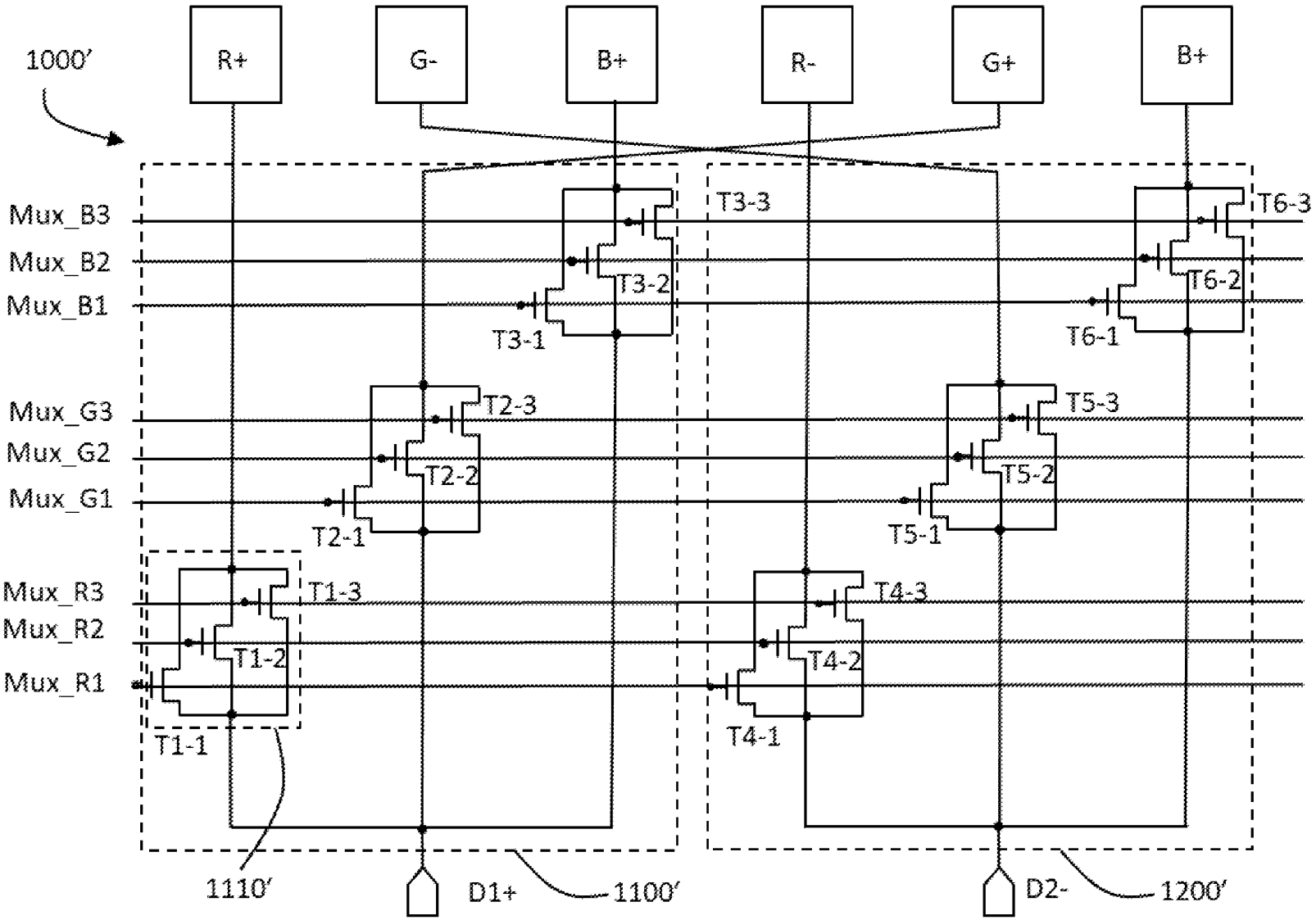
FIG. 6 is a schematic view of a structure of a multiplexing circuit according to an embodiment of the present disclosure.

Referring to FIG. 6, in one embodiment of the disclosure, the first switching unit 1110' further includes a third switch T1-3. The third switch T1-3 is electrically connected between the first output end D1+ and the first sub-pixel R+. The first switch T1-1, the second switch T1-2, and the third switch T1-3 are configured to simultaneously turn on, or turn on separately to transmit the signal to the first sub-pixel R+.

In one embodiment of the disclosure, a multiplexing circuit 1000' further comprising a first control line Mux_R1, a second control line Mux_R2, and a third control line Mux_R3. The first control line Mux_R1 is electrically connected to the first switch T1-1 to control the first switch T1-1 turning on or off. The second control line Mux_R2 is electrically connected to the second switch T1-2 to control the second switch T1-2 turning on or off. The third control line Mux_R3 is electrically connected to the third switch T1-3 to control the third switch T1-3 turning on or off.

In detail, both of the first multiplexing unit 1100' and the second multiplexing unit 1200' of the multiplexing circuit 1000' include three switching units. Each switching unit includes three switches. Each switching unit is corresponding to a sub-pixel respectively.

In detail, switching units corresponding to red sub-pixels R+ and R− are controlled by three control lines Mux_R1, Mux_R2, and Mux_R3. Switching units corresponding to green sub-pixels G− and G+ are controlled by three control lines Mux_G1, Mux_G2, and Mux_G3. Switching units corresponding to blue sub-pixels B+ and B− are controlled by three control lines Mux_B1, Mux_B2, and Mux_B3.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 7:
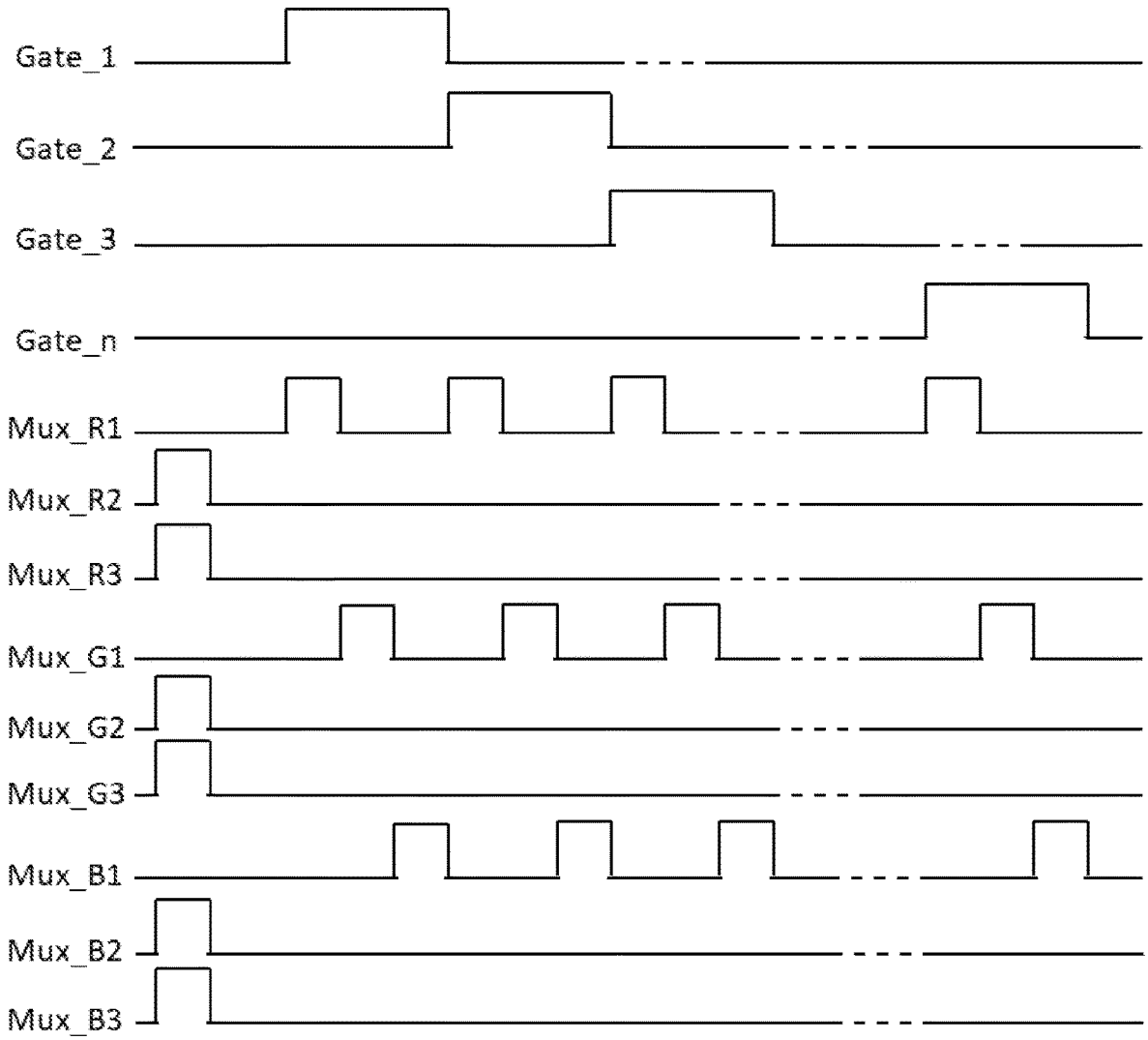
FIG. 7 is a signal timing schematic diagram of the multiplexing circuit according to the embodiment of FIG. 6 of the present disclosure.

Referring to FIG. 7, in detail, the multiplexing circuit 1000' provides signal in means of that shown in FIG. 7 that only one switch in each switching unit is turning on when the display device needs less width to length ratio of transistor channel to achieve an advantage of less power consumption without low-frequency flickering.

Figure 8:
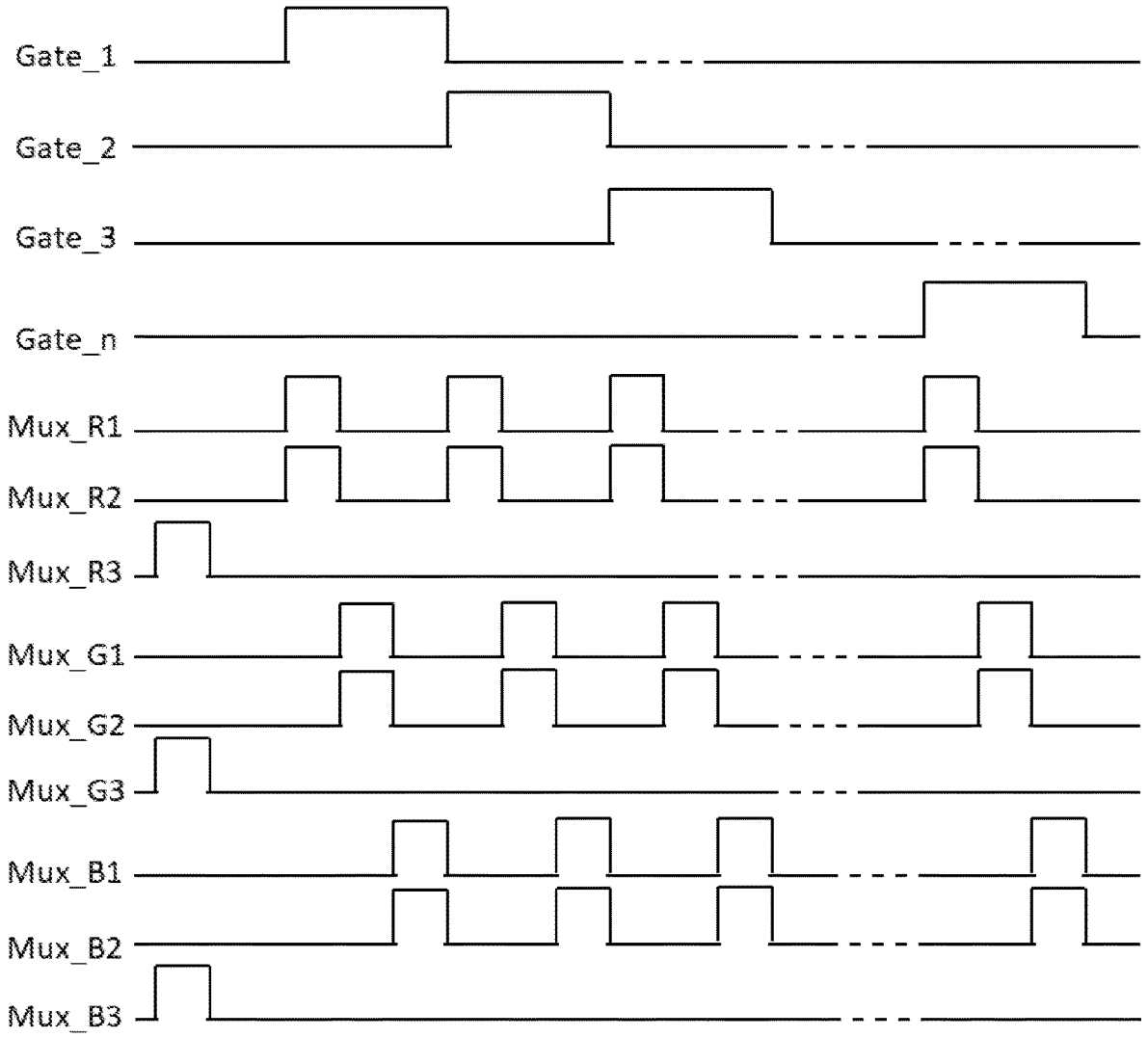
FIG. 8 is a signal timing schematic diagram of the multiplexing circuit according to another embodiment of FIG. 6 of the present disclosure.

Referring to FIG. 8, in detail, the multiplexing circuit 1000' provides signal in means of that shown in FIG. 8 that two switches in each switching unit are turning on when the display device needs much width to length ratio of transistor channel to provide greater equivalent width to length ratio.

Figure 9:
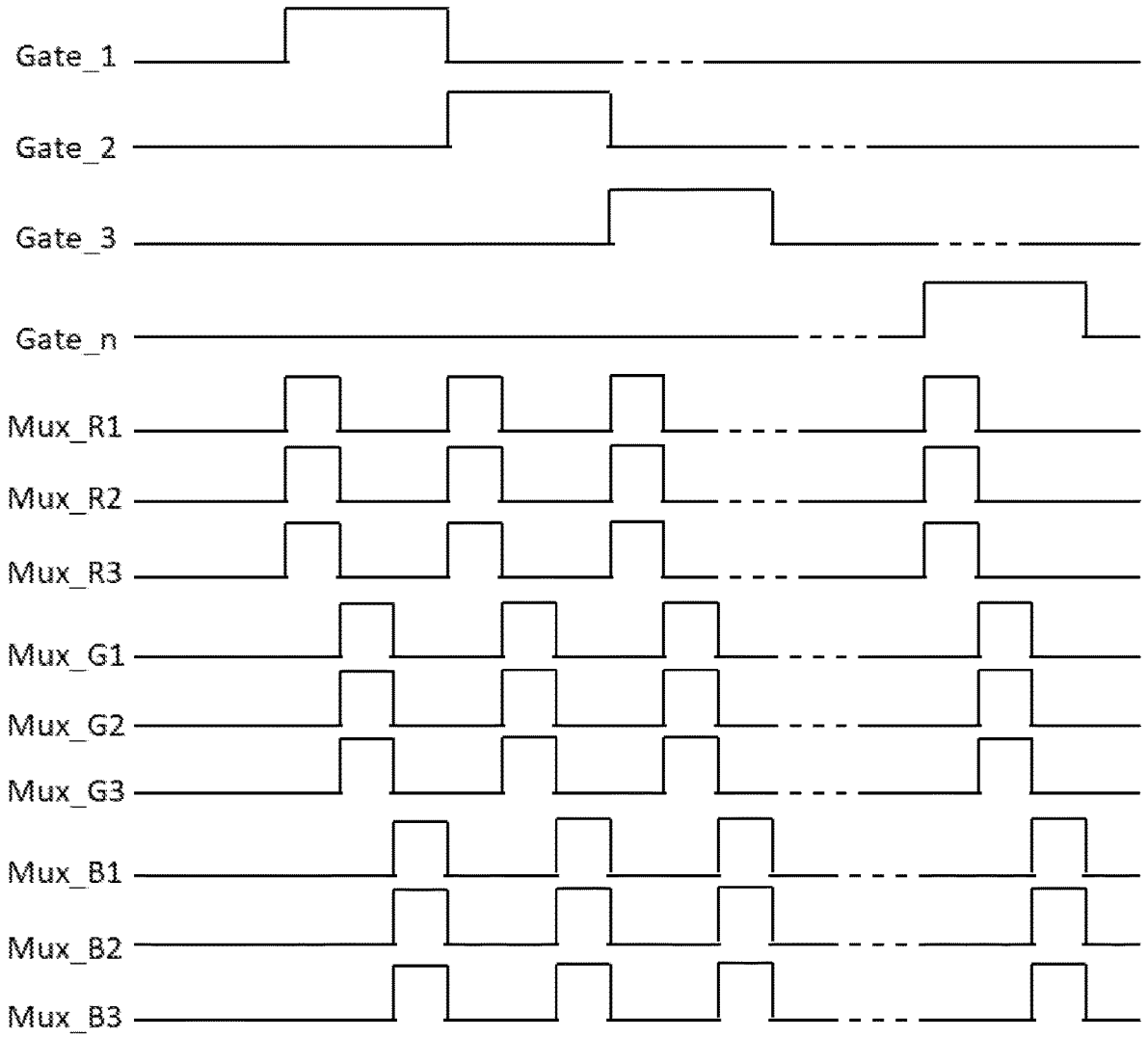
FIG. 9 is a signal timing schematic diagram of the multiplexing circuit according to still another embodiment of FIG. 6 of the present disclosure.

Referring to FIG. 9, in detail, the multiplexing circuit 1000' provides signal in means of that shown in FIG. 9 that three switches in each switching unit are turning on when the display device needs even more width to length ratio of transistor channel to provide even greater equivalent width to length ratio.

Figure 10:
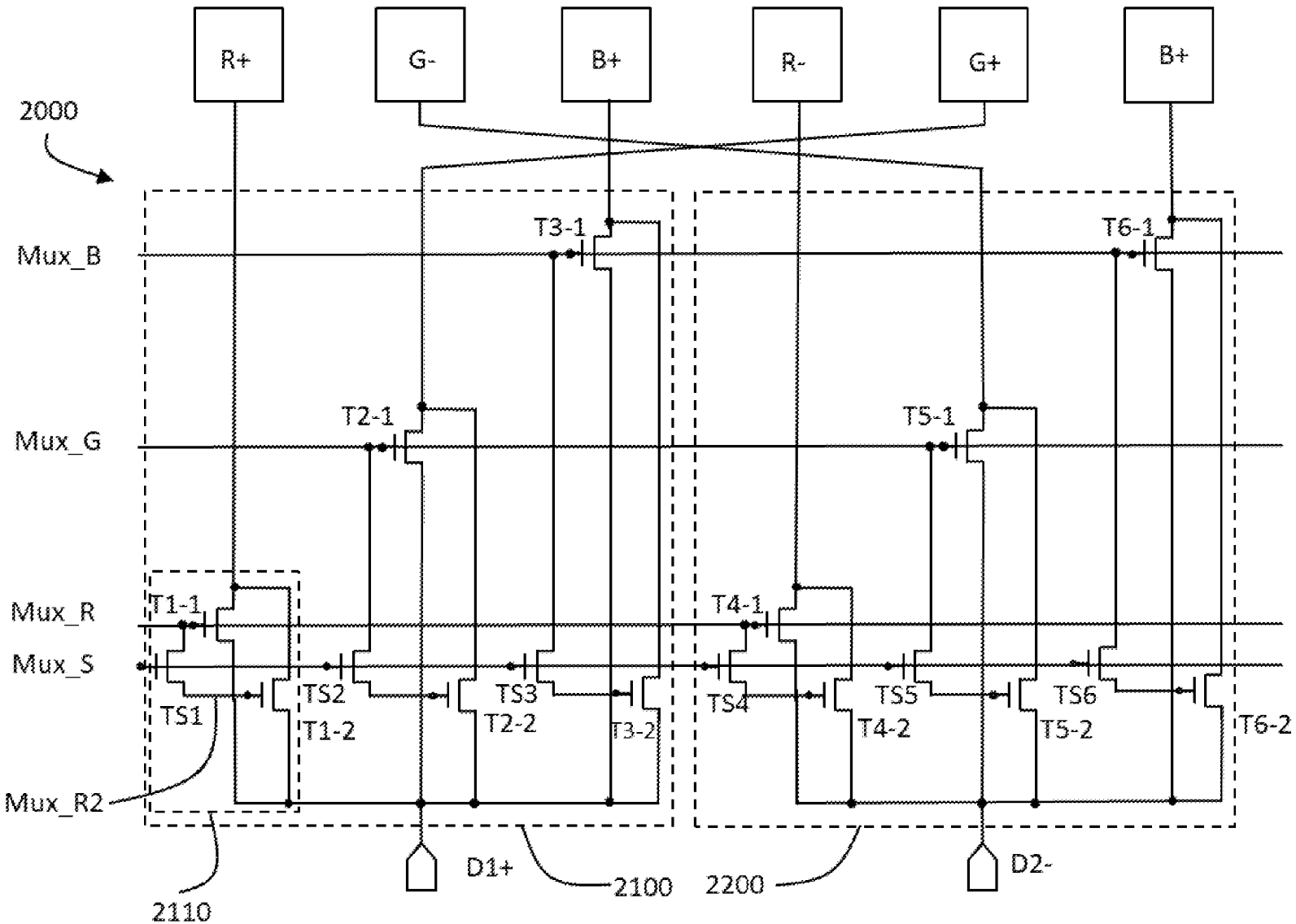
FIG. 10 is a schematic view of a structure of a multiplexing circuit according to an embodiment of the present disclosure.

Referring to FIG. 10, in one embodiment of the disclosure, a first switching unit 2110 further includes a first selecting switch TS1 electrically connected between a first control line Mux_R and a second control line Mux_R2 to control a second switch T1-2 turning on or off. The multiplexing circuit 2000 further includes a first selecting signal line Mux_S configured to control the first selecting switch TS1 turning on or off.

In detail, each multiplexing unit includes three switching units. Each switching unit is corresponding to one selecting switch.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 11:
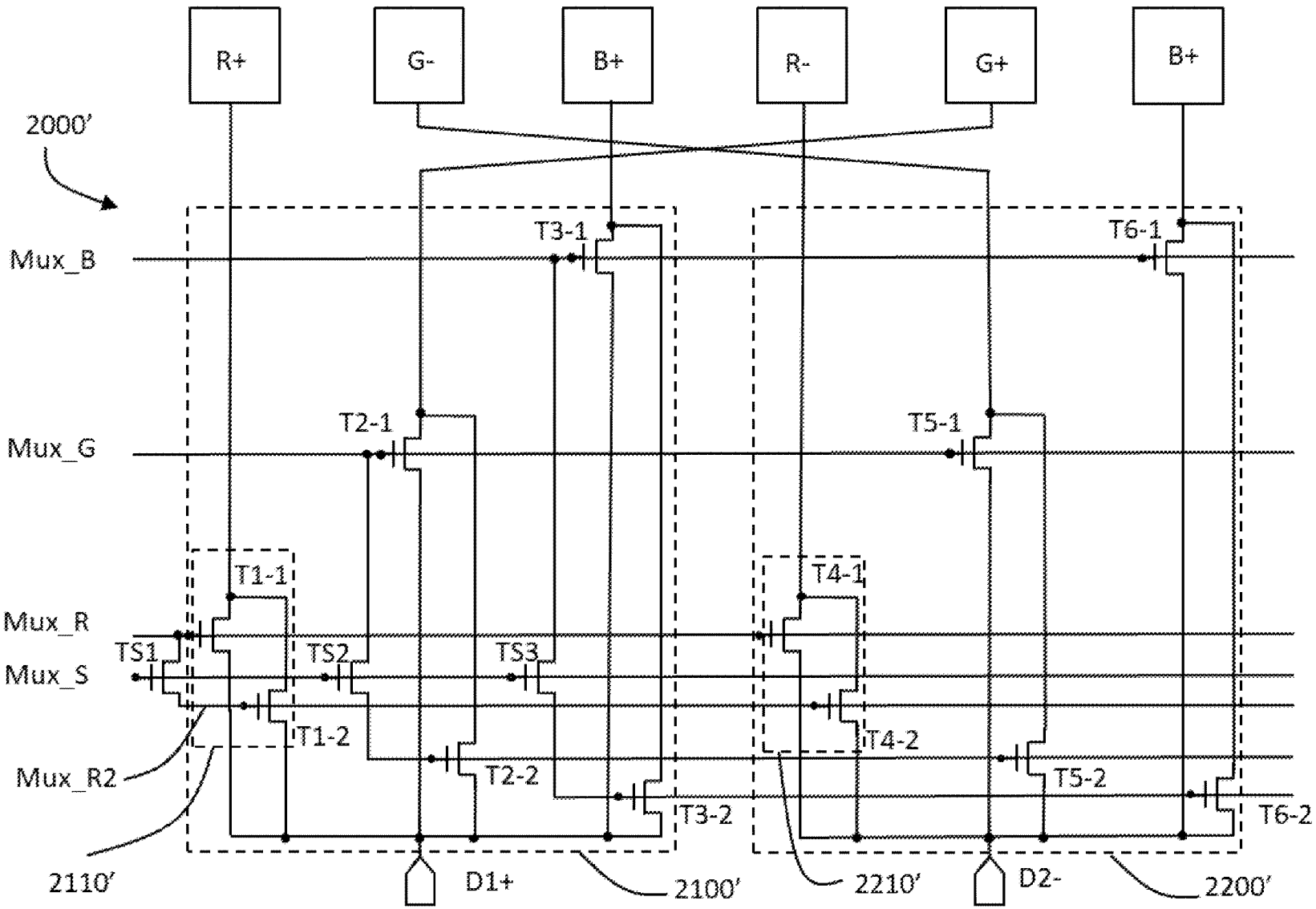
FIG. 11 is a schematic view of a structure of a multiplexing circuit according to an embodiment of the present disclosure.

Referring to FIG. 11, in one embodiment of the disclosure, a multiplexing circuit 2000' further includes a first selecting switch TS1 electrically connected between the first control line Mux_R and the second control line Mux_R2 to control the second switch T1-2 turning on or off. The multiplexing circuit 2000' further includes a first selecting signal line Mux_S configured to control the first selecting switch TS1 turning on or off.

In one embodiment of the disclosure, the multiplexing circuit 2000' further includes a second multiplexing unit 2200' configured to receive a signal at a second output end D2– of the source driving circuit of the display and configured to transmit the signal to the pixel of the display. The second multiplexing unit 2200' includes a first switching unit 2210' configured to control transmitting of the signal to a first sub-pixel R– of a second pixel of the display. The first switching unit 2210' of the second multiplexing unit 2200' includes a first switch T4-1 and a second switch T4-2. Both the first switch T4-1 of the second multiplexing unit 2200' and the second switch T4-2 of the second multiplexing unit 2200' are electrically connected between the second output end D2– and the first sub-pixel R– of the second pixel. The first selecting switch TS1 is electrically connected to the second switch T4-2 of the second multiplexing unit 2200' to control the second switch T4-2 of the second multiplexing unit 2200' turning on or off.

In detail, referring to FIG. 11, the multiplexing circuit 2000' is simplified from the multiplexing circuit 2000. Only a first multiplexing unit 2100' includes selecting switches TS1, TS2, and TS3. The first multiplexing unit 2100' shares selecting switches TS1, TS2, and TS3 with a second multiplexing unit 2200'. The arrangement here can reduce numbers of the selecting switches, and reduce cost and area of circuit to enhance density of circuit.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 12:
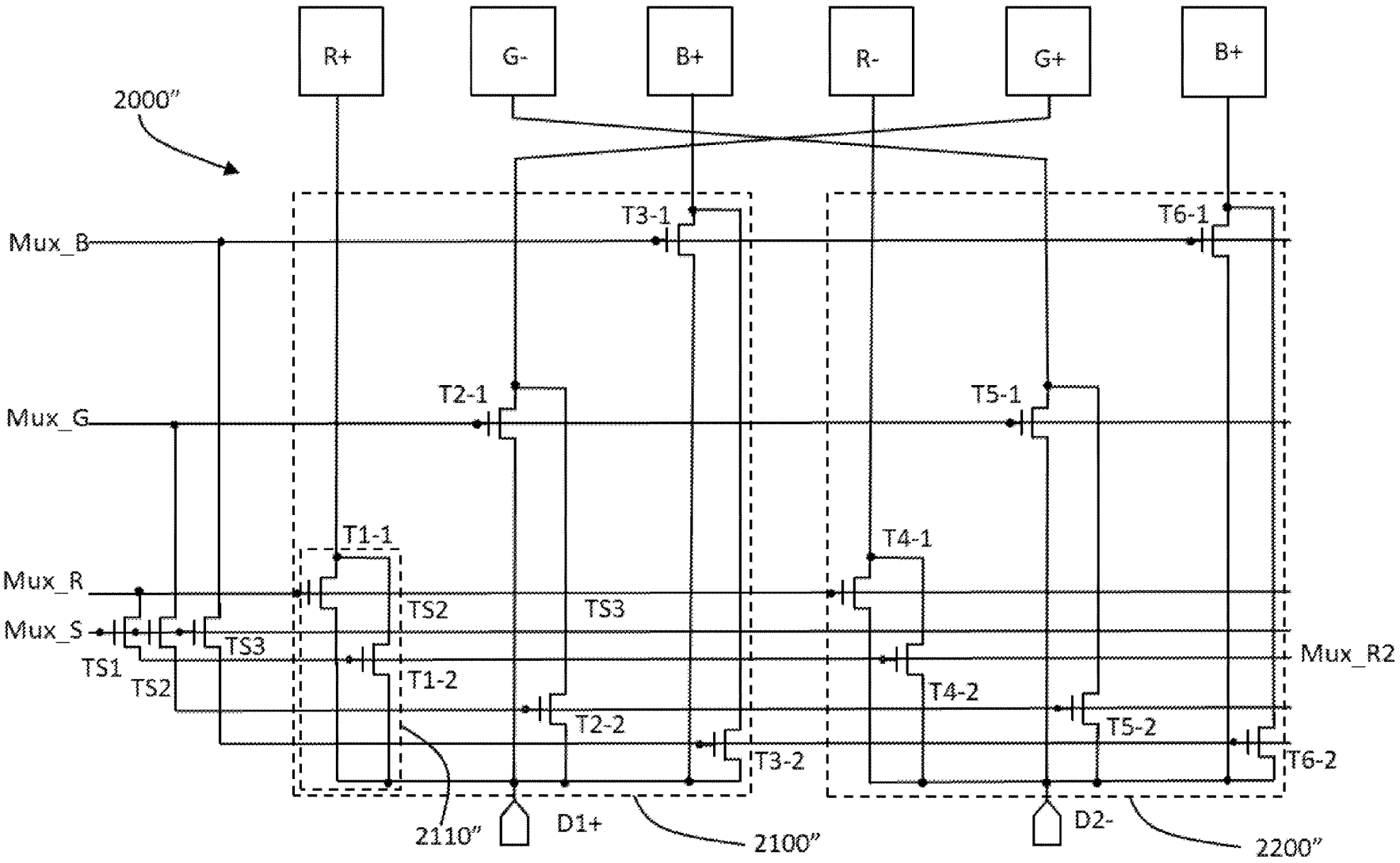
FIG. 12 is a schematic view of a structure of a multiplexing circuit according to an embodiment of the present disclosure.

In detail, referring to FIG. 12, the multiplexing circuit 2000" is simplified from the multiplexing circuit 2000'. The selecting switches TS1, TS2, and TS3 are removed from the first multiplexing unit 2100' to arrange together. The arrangement here can reduce area of circuit to enhance density of circuit.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 13:
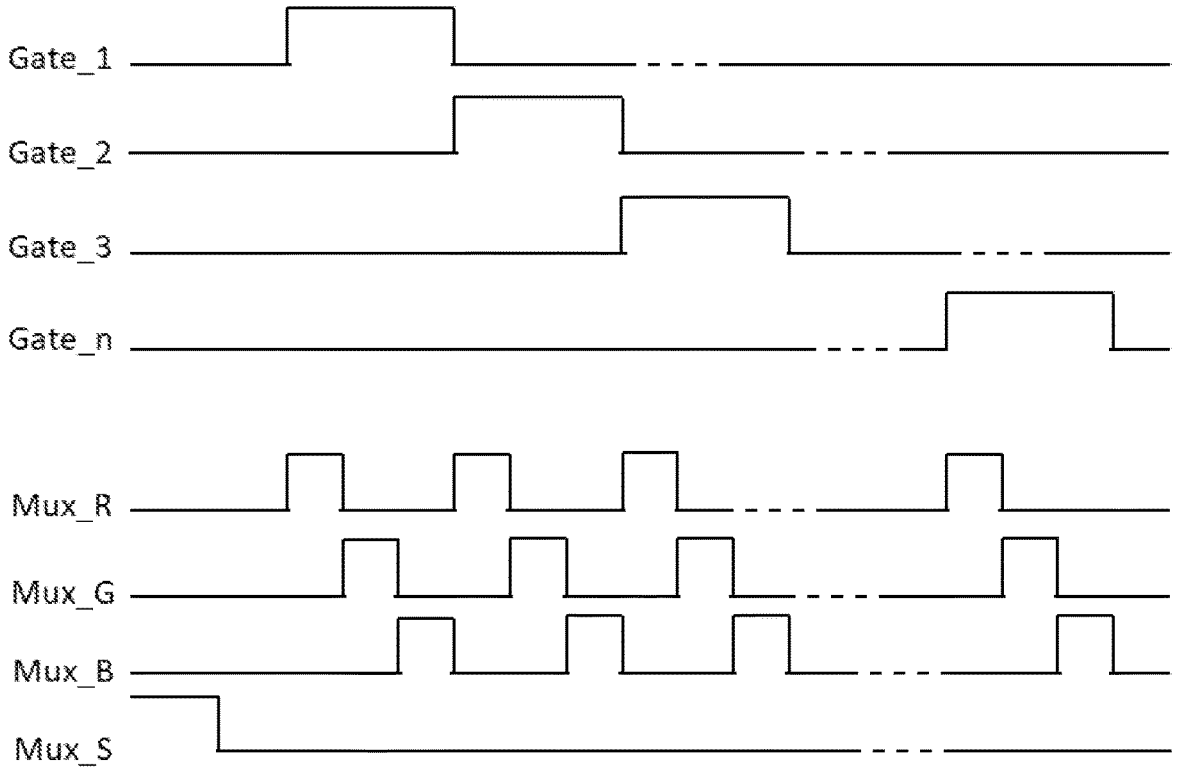
FIG. 13 is a signal timing schematic diagram of the multiplexing circuit according to the embodiments of FIG. 10 to FIG. 12 of the present disclosure.

Referring to FIG. 13, in detail, the multiplexing circuit 2000, 2000', and 2000" provide signal in means of that shown in FIG. 13 that only one switch in each switching unit is turning on when the display device needs less width to length ratio of transistor channel to achieve an advantage of less power consumption without low-frequency flickering.

Figure 14:
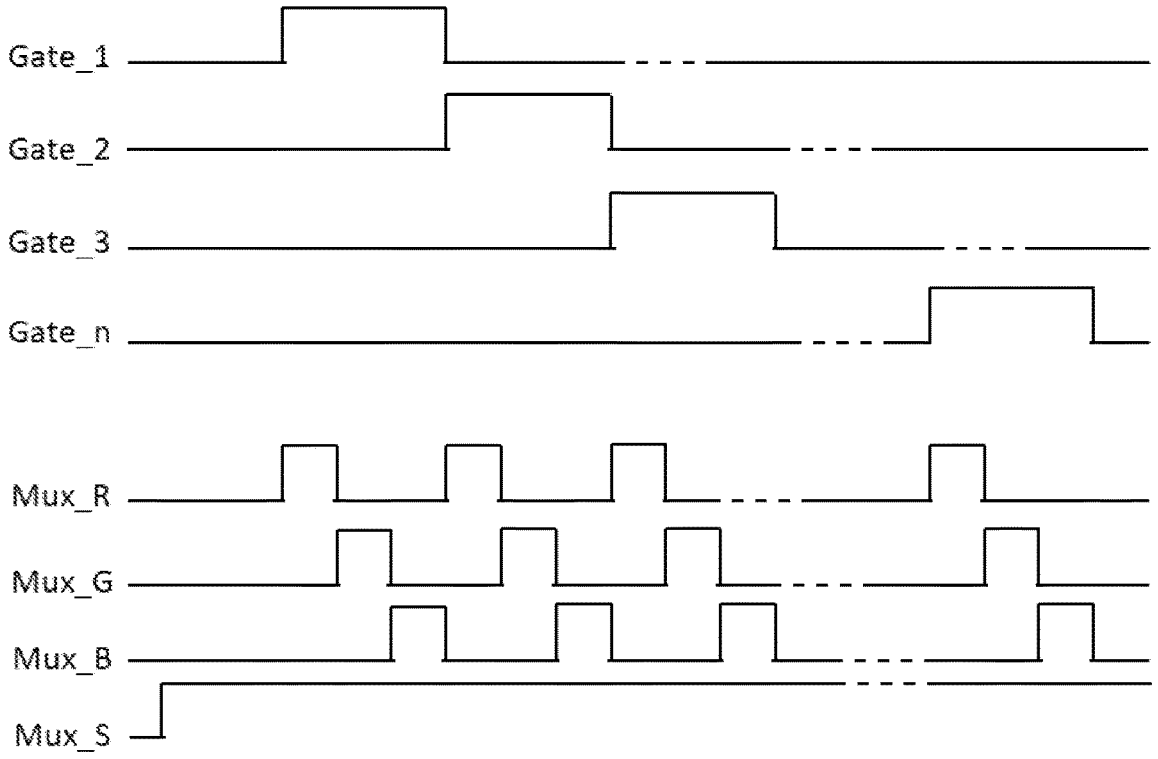
FIG. 14 is a signal timing schematic diagram of the multiplexing circuit according to another embodiments of FIG. 10 to FIG. 12 of the present disclosure.

Referring to FIG. 14, in detail, the multiplexing circuit 2000, 2000', and 2000" provide signal in means of that shown in FIG. 14 that two switches in each switching unit are turning on when the display device needs much width to length ratio of transistor channel to provide greater equivalent width to length ratio.

Figure 15:
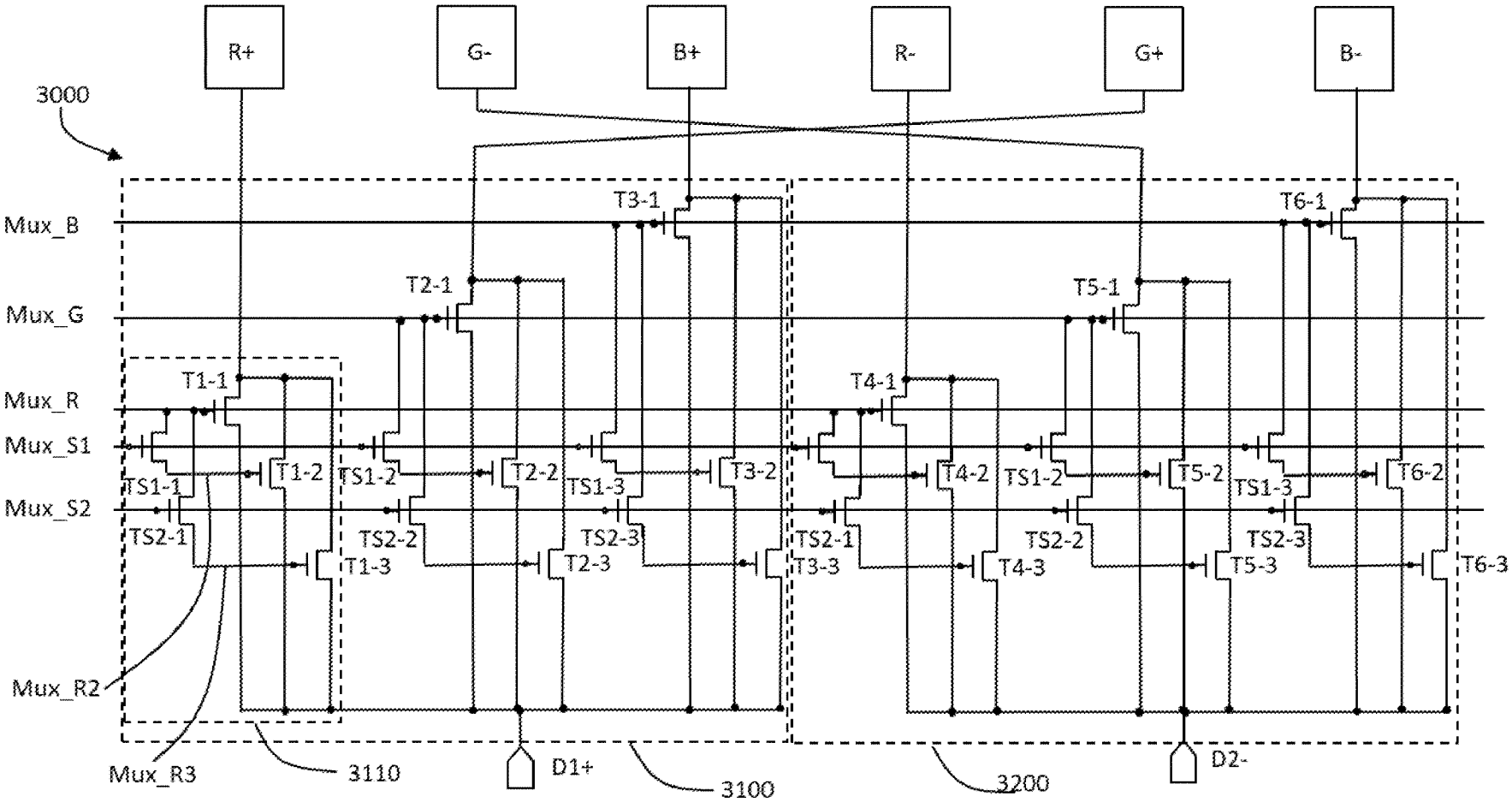
FIG. 15 is a schematic view of a structure of a multiplexing circuit according to an embodiment of the present disclosure.

Referring to FIG. 15, in one embodiment of the disclosure, a first switching unit 3110 further includes a first selecting switch TS1-1 and a second selecting switch TS2-1. The first selecting switch TS1-1 is electrically connected between the first control line Mux_R and the second control line Mux_R2 to control the second switch T1-2 turning on or off. The second selecting switch TS2-1 is electrically connected between the first control line Mux_R and the third control line Mux_R3 to control the third switch T1-3 turning on or off. A multiplexing circuit 3000 further includes a first selecting signal line Mux_S1 and a second selecting signal line Mux_S2. The first selecting signal line Mux_S1 is configured to control the first selecting switch TS1-1 turning on or off, and the second selecting signal line Mux_S2 is configured to control the second selecting switch TS2-1 turning on or off.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 18:
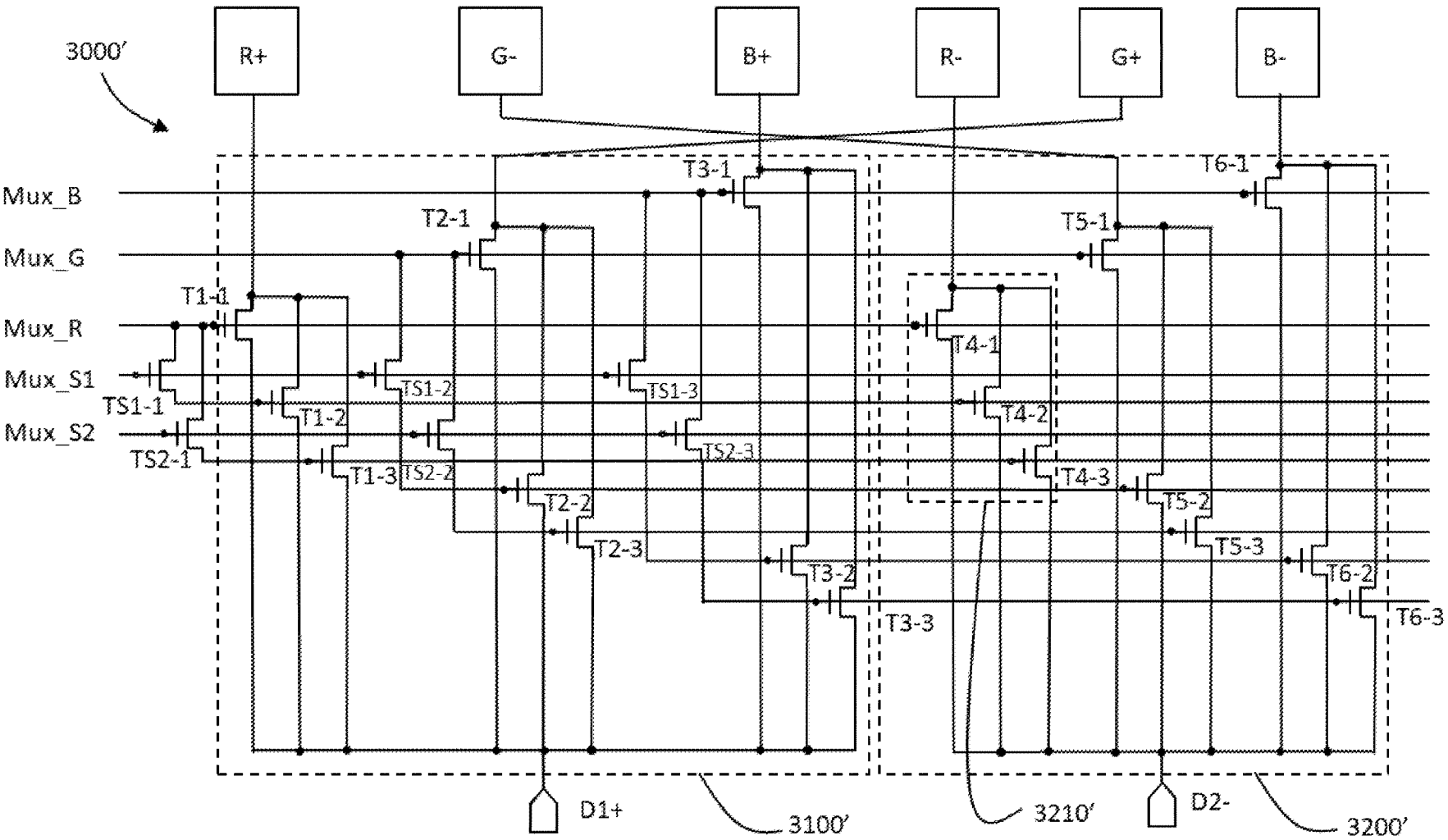
FIG. 18 is a schematic view of a structure of a multiplexing circuit according to an embodiment of the present disclosure.

Referring to FIG. 18, in one embodiment of the disclosure, a multiplexing circuit 3000' further includes second multiplexing unit 3200' configured to receive a signal at a second output end D2– of the source driving circuit of the display and configured to transmit the signal to the pixel of the display. The second multiplexing unit 3200' includes a first switching unit 3210' configured to control transmitting of the signal to a first sub-pixel R− of a second pixel of the display. The first switching unit 3210' of the second multiplexing unit 3200' includes a first switch T4-1, a second switch T4-2, and a third switch T4-3. All the first switch T4-1 of the second multiplexing unit 3200', the second switch T4-2 of the second multiplexing unit 3200', and the third switch T4-3 of the second multiplexing unit 3200' are electrically connected between the second output end D2− and the first sub-pixel R− of the second pixel. A first selecting switch TS1-1 is electrically connected to the second switch T4-2 of the second multiplexing unit 3200' to control the second switch T4-2 of the second multiplexing unit 3200' turning on or off. A second selecting switch TS2-1 is electrically connected to the third switch T4-3 of the second multiplexing unit 3200' to control the third switch T4-3 of the second multiplexing unit 3200' turning on or off.

In detail, the multiplexing circuit 3000' is simplified from the multiplexing circuit 3000. Only a first multiplexing unit 3100' includes first selecting switches TS1-1, TS1-2, and TS1-3, and second selecting switches TS2-1, TS2-2, and TS2-3. The first multiplexing unit 3100' shares first selecting switches TS1-1, TS1-2, and TS1-3, and second selecting switches TS2-1, TS2-2, and TS2-3 with a second multiplexing unit 3200'. The arrangement here can reduce numbers of the selecting switches, and reduce cost and area of circuit to enhance density of circuit.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 19:
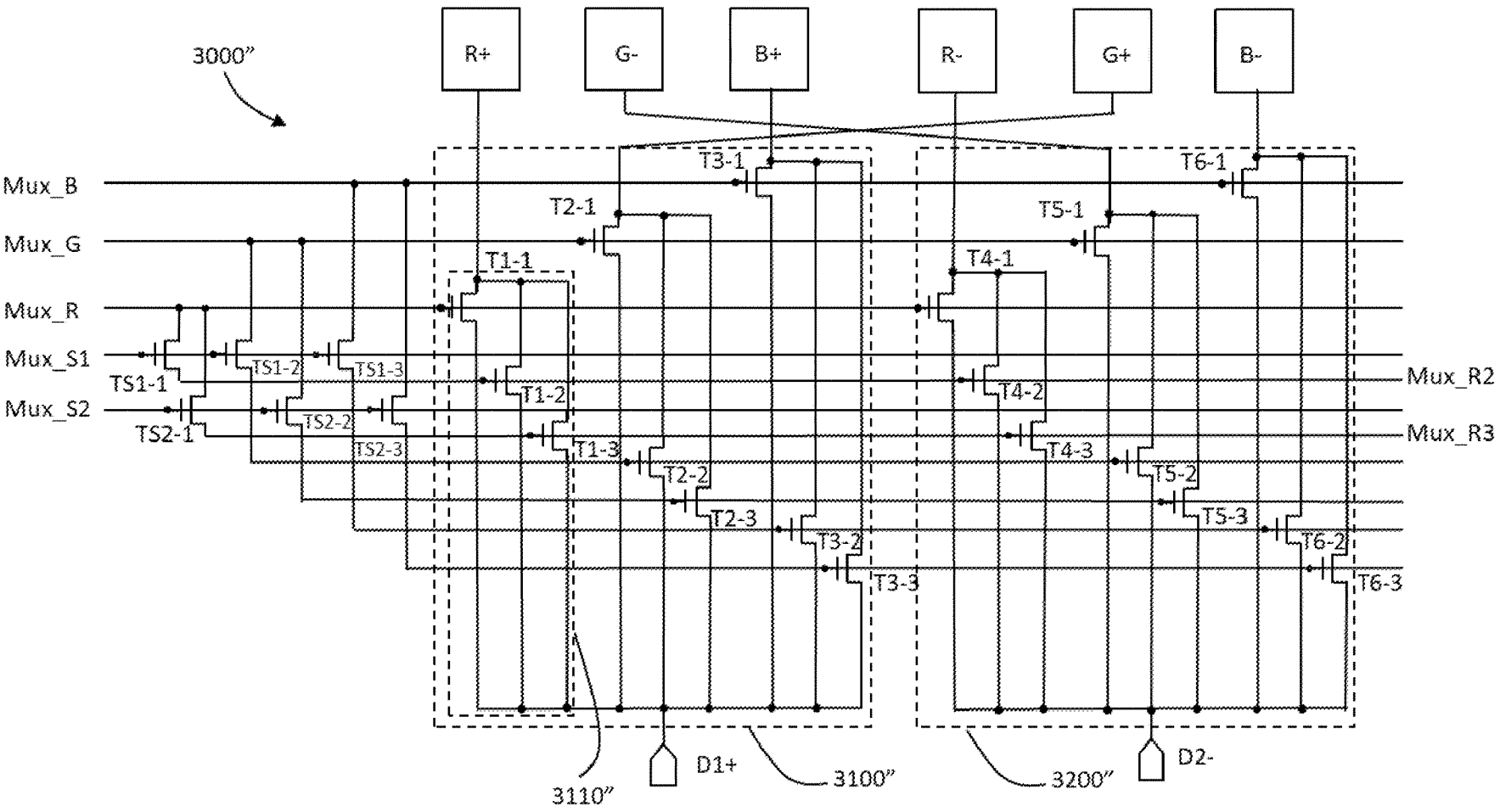
FIG. 19 is a schematic view of a structure of a multiplexing circuit according to an embodiment of the present disclosure.

Referring to FIG. 19, in one embodiment of the disclosure, a multiplexing circuit 3000" further includes a first selecting switch TS1-1 and a second selecting switch TS2-1. The first selecting switch TS1-1 is electrically connected between the first control line Mux_R and the second control line Mux_R2 to control the second switch T1-2 turning on or off. The second selecting switch TS2-1 is electrically connected between the first control line Mux_R and the third control line Mux_R3 to control the third switch T1-3 turning on or off. The multiplexing circuit 3000" further includes a first selecting signal line Mux_S1 and a second selecting signal line Mux_S2. The first selecting signal line Mux_S1 is configured to control the first selecting switch TS1-1 turning on or off, and the second selecting signal line Mux_S2 is configured to control the second selecting switch TS2-1 turning on or off.

In detail, the multiplexing circuit 3000" is simplified from the multiplexing circuit 3000'. The first selecting switches TS1-1, TS1-2, and TS1-3, and second selecting switches TS2-1, TS2-2, and TS2-3 of multiplexing circuit 3000' are removed from the first multiplexing unit 3100' to arrange together. The arrangement here can reduce area of circuit to enhance density of circuit.

In detail, the switch is P channel MOSFET, N channel MOSFET, or thin film transistor, for example. The disclosure is not limit about it.

In detail, numbers of the sub-pixels and numbers of the multiplexing units are merely examples, and the disclosure is not limited thereto.

Figure 16:
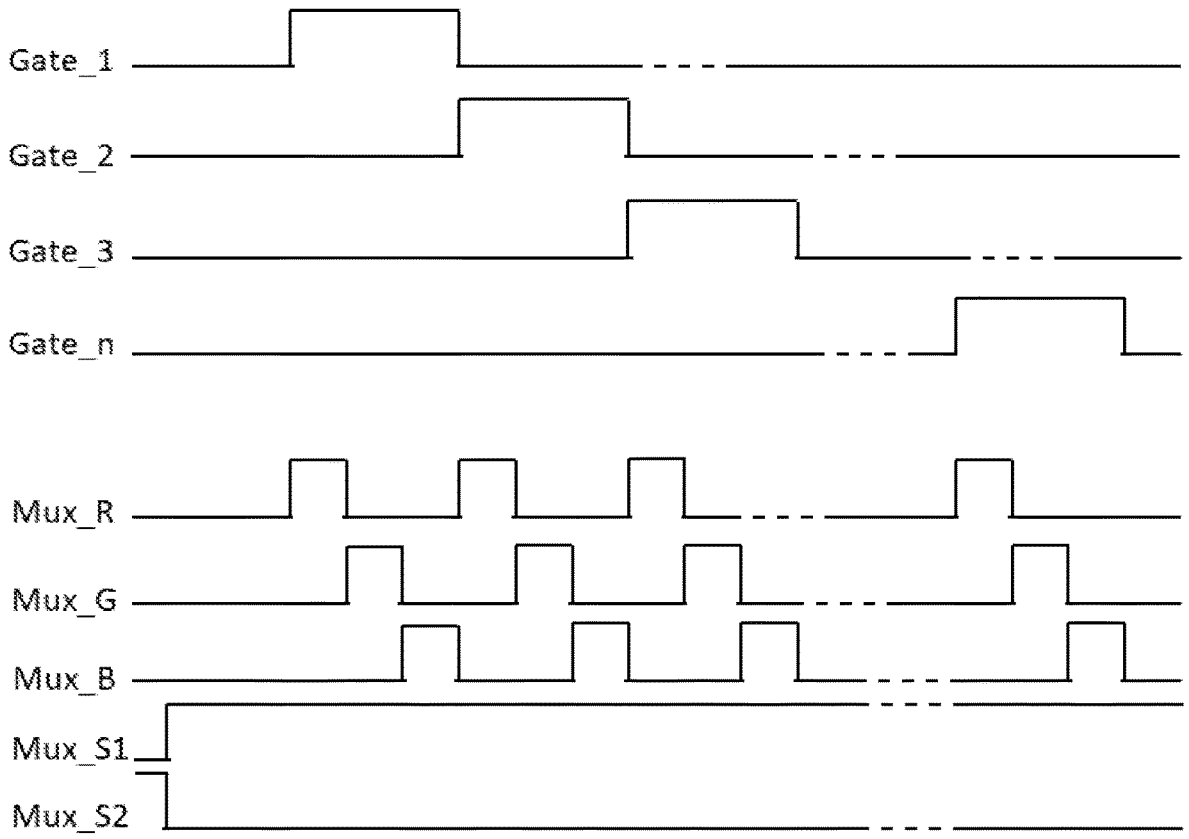
FIG. 16 is a signal timing schematic diagram of the multiplexing circuit according to the embodiment of FIG. 15 of the present disclosure.

Referring to FIG. 16, in detail, the multiplexing circuit 3000, 3000', and 3000" provide signal in means of that shown in FIG. 16 that two switches in each switching unit are turning on when the display device needs much width to length ratio of transistor channel to provide greater equivalent width to length ratio.

Figure 17:
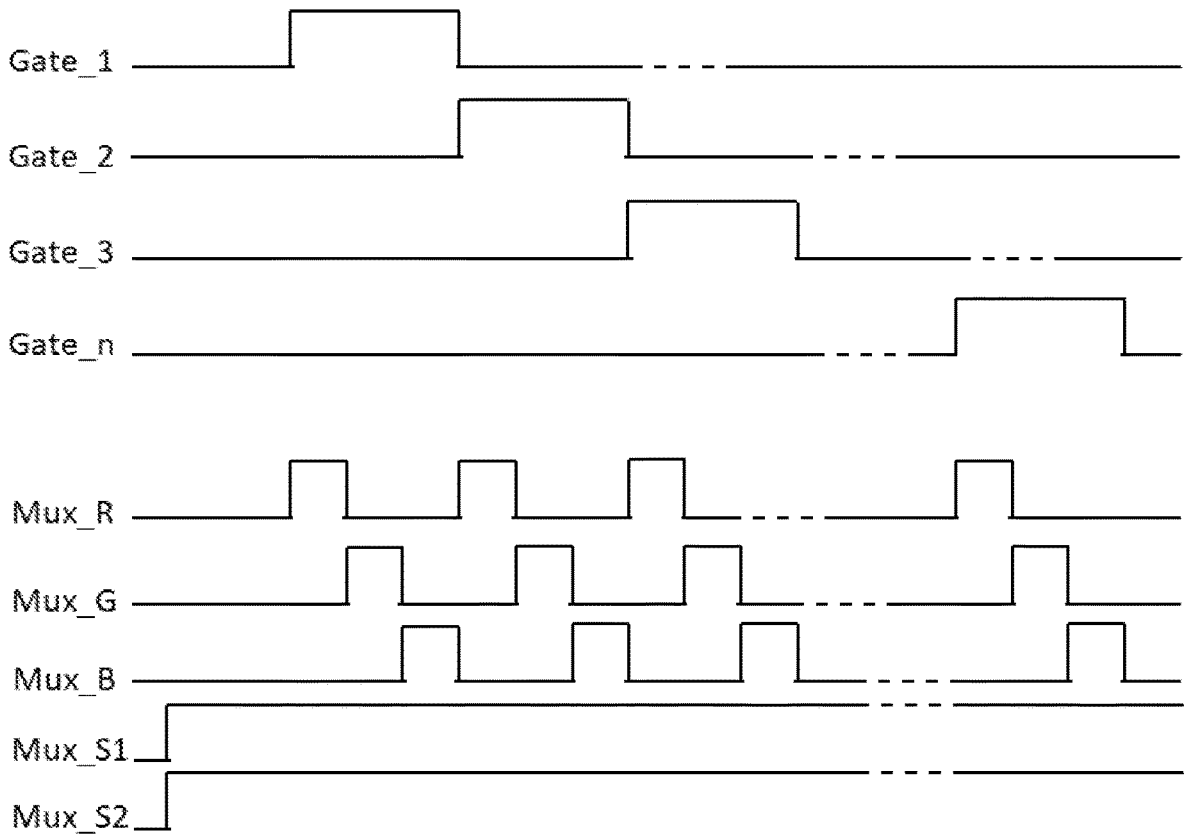
FIG. 17 is a signal timing schematic diagram of the multiplexing circuit according to another embodiment of FIG. 15 of the present disclosure.

Referring to FIG. 17, in detail, the multiplexing circuit 3000, 3000', and 3000" provide signal in means of that shown in FIG. 17 that three switches in each switching unit are turning on when the display device needs even more width to length ratio of transistor channel to provide even greater equivalent width to length ratio.

In detail, the multiplexing circuit 1000' provides signal similar with the multiplexing circuit 2000 that only one switch in each switching unit is turning on when the display device needs less width to length ratio of transistor channel to achieve an advantage of less power consumption without low-frequency flickering.

In detail, all the aforementioned multiplexing circuits are one to three multiplexing circuit, but the disclosure is not limit thereto. In one embodiment of the disclosure, the multiplexing circuit may be a one to two multiplexing circuit, a one to four multiplexing circuit, or a one to six multiplexing circuit.

Figure 20:
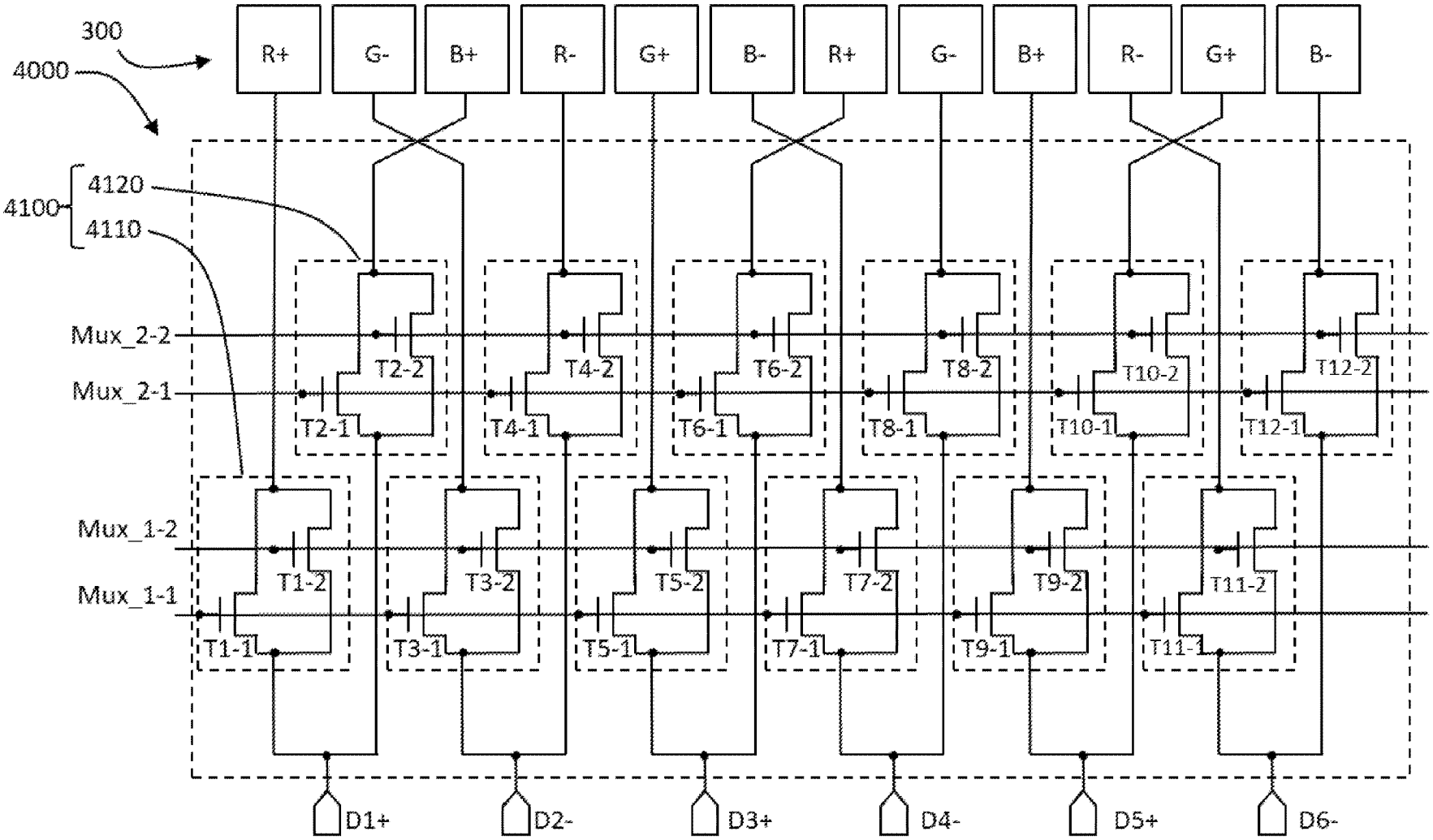
FIG. 20 is a schematic view of a structure of a multiplexing circuit according to an embodiment of the present disclosure.

In detail, referring to FIG. 20, an embodiment of the disclosure provides a one to two multiplexing circuit 4000 including a first switching unit 4110, and a second switching unit 4120. Each switching unit of the multiplexing circuit 4000 may include three switches as that of the multiplexing circuit 1000'. The multiplexing circuit 4000 may include a selecting switch as the multiplexing circuit 2000, or include a simplified circuit as the multiplexing circuit 2000', or 2000", the disclosure will not be described again.

In detail, each switching unit of the multiplexing circuit 4000 may include three switches and two selecting switches as that of the multiplexing circuit 3000, or include a simplified circuit as the multiplexing circuit 3000', or 3000", the disclosure will not be described again.

Figure 21:
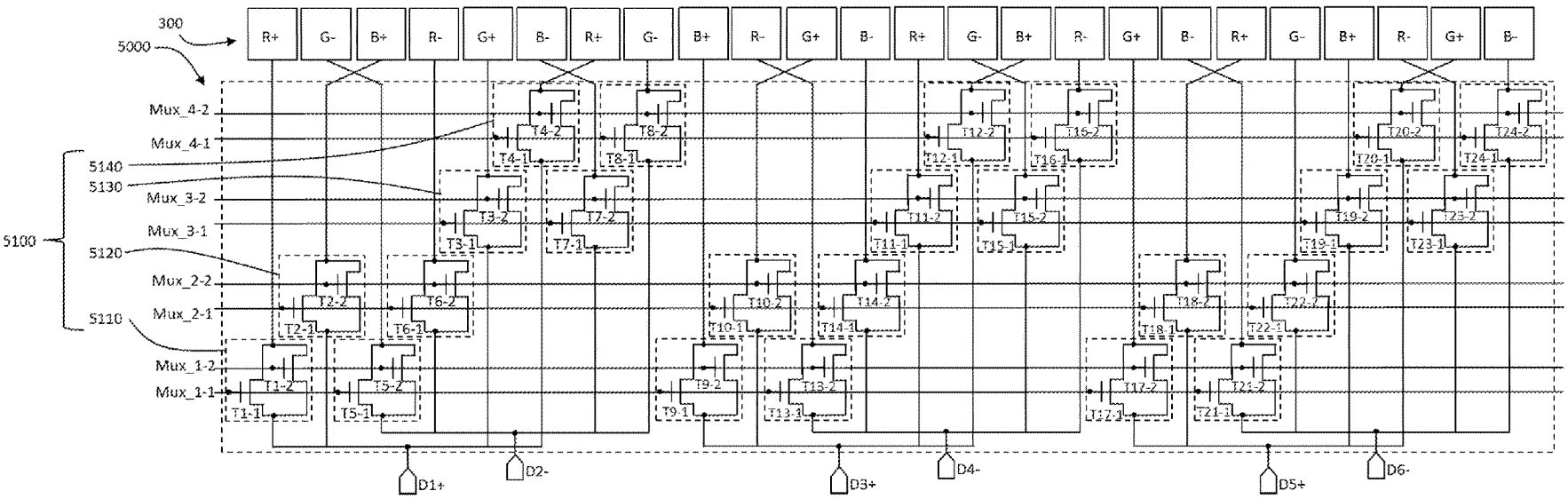
FIG. 21 is a schematic view of a structure of a multiplexing circuit according to an embodiment of the present disclosure.

In detail, referring to FIG. 21, an embodiment of the disclosure provides a one to four multiplexing circuit 5000 including a first switching unit 5110, a second switching unit 5120, a third switching unit 5130, and a fourth switching unit 5140. Each switching unit of the multiplexing circuit 5000 may include three switches as that of the multiplexing circuit 1000'. The multiplexing circuit 5000 may include a selecting switch as the multiplexing circuit 2000, or include a simplified circuit as the multiplexing circuit 2000', or 2000", the disclosure will not be described again.

In detail, each switching unit of the multiplexing circuit 5000 may include three switches and two selecting switches as that of the multiplexing circuit 3000, or include a simplified circuit as the multiplexing circuit 3000', or 3000", the disclosure will not be described again.

Figure 22:
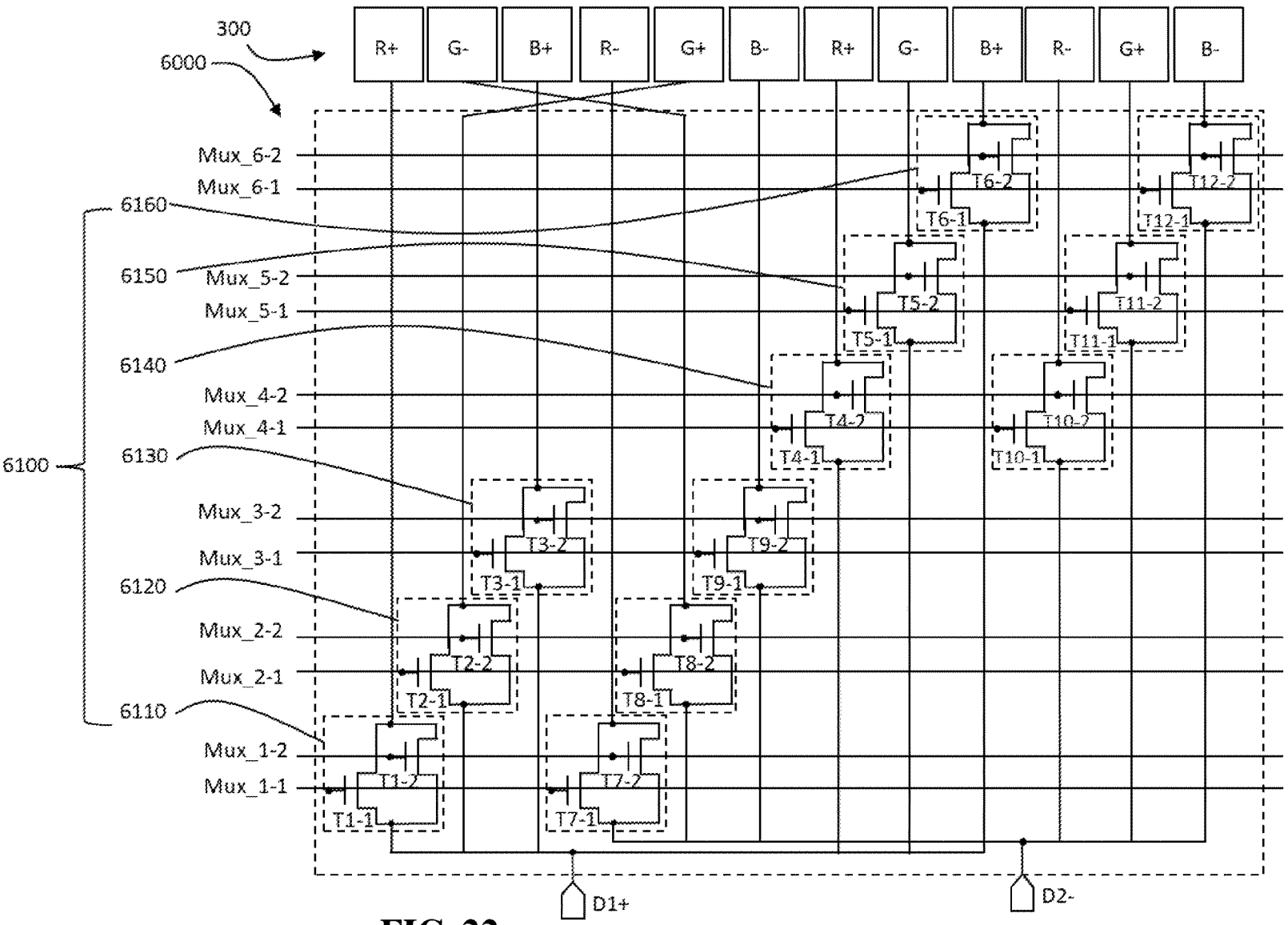
FIG. 22 is a schematic view of a structure of a multiplexing circuit according to an embodiment of the present disclosure.

In detail, referring to FIG. 22, an embodiment of the disclosure provides a one to six multiplexing circuit 6000 including a first switching unit 6110, a second switching unit 6120, a third switching unit 6130, a fourth switching unit 6140, a fifth switching unit 6150, and a sixth switching unit 6160. Each switching unit of the multiplexing circuit 6000 may include three switches as that of the multiplexing circuit 1000'. The multiplexing circuit 6000 may include a selecting switch as the multiplexing circuit 2000, or include a simplified circuit as the multiplexing circuit 2000', or 2000", the disclosure will not be described again.

In detail, each switching unit of the multiplexing circuit 6000 may include three switches and two selecting switches as that of the multiplexing circuit 3000, or include a simplified circuit as the multiplexing circuit 3000', or 3000", the disclosure will not be described again.

In comparison with the prior art, one embodiment of the disclosure provides the multiplexing circuit with every switching unit having at least two controllable switches to simultaneously turn on or turn on only one to transmit the signal to a sub-pixel. A display device can select appropriate width to length ratio of transistor channel at different frame rates to improve display quality of images and to consume less power without causing low-frequency flickering of the images.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A multiplexing circuit, comprising:

a first multiplexing unit;

a first control line; and a second control line;

wherein the first multiplexing unit is configured to receive a signal at a first output end of a source driving circuit of a display and configured to transmit the signal to a pixel of the display;

wherein the first multiplexing unit comprises a first switching unit configured to control transmitting of the signal to a first sub-pixel of a first pixel of the display;

wherein the first switching unit comprises a first switch and a second switch;

wherein one end of the first switch and one end of the second switch are electrically connected to between the first output end directly and another end of the first switch and another end of the second switch are electrically connected to the first sub-pixel of the first pixel directly;

wherein the first control line is electrically connected to the first switch directly to control the first switch turning on or off, and the second control line is electrically connected to the second switch directly to control the second switch turning on or off;

wherein the first switch and the second switch are configured to simultaneously turn on or turn on only one to transmit the signal to the first sub-pixel of the first pixel; and wherein the first multiplexing unit further comprises a first selecting switch, wherein one end of the first selecting switch is electrically connected to the first control line directly and another end of the first selecting switch is electrically connected to the second control line directly to control the second switch turning on or off, and the multiplexing circuit further comprises a first selecting signal line configured to control the first selecting switch turning on or off.

2. The multiplexing circuit according to claim 1, further comprising a second multiplexing unit configured to receive a signal at a second output end of the source driving circuit of the display and configured to transmit the signal to the pixel of the display;

wherein the second multiplexing unit comprises a first selecting switch and a first switching unit configured to control transmitting of the signal to a first sub-pixel of a second pixel of the display;

wherein the first switching unit of the second multiplexing unit comprises a first switch and a second switch;

wherein one end of the first switch of the second multiplexing unit and one end of the second switch of the second multiplexing unit are electrically connected to the first output end directly, and another end of the first switch of the second multiplexing unit and another end of the second switch of the second multiplexing unit are electrically connected to the first sub-pixel of the second pixel directly; and wherein the first selecting switch of the second multiplexing unit is electrically connected to the second switch of the second multiplexing unit directly to control the second switch of the second multiplexing unit turning on or off.

3. The multiplexing circuit according to claim 1, further comprising a second multiplexing unit configured to receive a signal at a second output end of the source driving circuit of the display and configured to transmit the signal to the pixel of the display;

wherein the second multiplexing unit comprises a first switching unit configured to control transmitting of the signal to a first sub-pixel of a second pixel of the display;

wherein the first switching unit of the second multiplexing unit comprises a first switch and a second switch;

wherein one end of the first switch of the second multiplexing unit and one end of the second switch of the second multiplexing unit are electrically connected to the second output end directly and another end of the first switch of the second multiplexing unit and another end of the second switch of the second multiplexing unit are electrically connected to the first sub-pixel of the second pixel directly; and wherein the first selecting switch of the first multiplexing unit is electrically connected to the second switch of the second multiplexing unit directly to control the second switch of the second multiplexing unit turning on or off.

4. The multiplexing circuit according to claim 1, wherein the first switching unit further comprises a third switch;

wherein one end of the third switch is electrically connected to the first output end directly and another end of the third switch is electrically connected to the first sub-pixel of the first pixel directly; and wherein the first switch, the second switch, and the third switch are configured to simultaneously turn on, turn on the first switch and the second switch only, or turn on the first switch only to transmit the signal to the first sub-pixel of the first pixel.

5. The multiplexing circuit according to claim 4, further comprising a third control line electrically connected to the third switch directly to control the third switch turning on or off.

6. The multiplexing circuit according to claim 5, wherein the first multiplexing unit further comprises a first selecting switch and a second selecting switch;

wherein one end of the first selecting switch is electrically connected to the first control line directly and another end of the first selecting switch is electrically connected to the second control line directly to control the second switch turning on or off;

wherein one end of the second selecting switch is electrically connected to the first control line directly and another end of the second selecting switch is electrically connected to the third control line directly to control the third switch turning on or off;

wherein the multiplexing circuit further comprises a first selecting signal line and a second selecting signal line; and wherein the first selecting signal line is configured to control the first selecting switch turning on or off, and the second selecting signal line is configured to control the second selecting switch turning on or off.

7. The multiplexing circuit according to claim 6, further comprising a second multiplexing unit configured to receive a signal at a second output end of the source driving circuit of the display and configured to transmit the signal to the pixel of the display;

wherein the second multiplexing unit comprises a first selecting switch, a second selecting switch, and a first switching unit configured to control transmitting of the signal to a first sub-pixel of a second pixel of the display;

wherein the first switching unit of the second multiplexing unit comprises a first switch, a second switch, and a third switch;

wherein one end of the first switch of the second multiplexing unit, one end of the second switch of the second multiplexing unit, and one end of the third switch of the second multiplexing unit are electrically connected to the second output end directly, and another end of the first switch of the second multiplexing unit, another end of the second switch of the second multiplexing unit, and another end of the third switch of the second multiplexing unit are electrically connected to the first sub-pixel of the second pixel directly;

wherein the first selecting switch of the second multiplexing unit is electrically connected to the second switch of the second multiplexing unit directly to control the second switch of the second multiplexing unit turning on or off; and wherein the second selecting switch of the second multiplexing unit is electrically connected to the third switch of the second multiplexing unit directly to control the third switch of the second multiplexing unit turning on or off.

8. The multiplexing circuit according to claim 6, further comprising a second multiplexing unit configured to receive a signal at a second output end of the source driving circuit of the display and configured to transmit the signal to the pixel of the display;

wherein the second multiplexing unit comprises a first switching unit configured to control transmitting of the signal to a first sub-pixel of a second pixel of the display;

wherein the first switching unit of the second multiplexing unit comprises a first switch, a second switch, and a third switch;

wherein one end of the first switch of the second multiplexing unit, one end of the second switch of the second multiplexing unit, and one end of the third switch of the second multiplexing unit are electrically connected to the second output end directly and another end of the first switch of the second multiplexing unit, another end of the second switch of the second multiplexing unit, and another end of the third switch of the second multiplexing unit are electrically connected to the first sub-pixel of the second pixel directly;

wherein the first selecting switch of the first multiplexing unit is electrically connected to the second switch of the second multiplexing unit directly to control the second switch of the second multiplexing unit turning on or off; and wherein the second selecting switch of the first multiplexing unit is electrically connected to the third switch of the second multiplexing unit directly to control the third switch of the second multiplexing unit turning on or off.

9. The multiplexing circuit according to claim 1, wherein the first multiplexing unit further comprises a second switching unit and a third switching unit;

wherein the second switching unit is configured to control transmitting of the signal to a second sub-pixel of the first pixel;

wherein the third switching unit is configured to control transmitting of the signal to a third sub-pixel of the first pixel;

wherein each of the second switching unit and the third switching unit comprises a first switch and a second switch;

wherein one end of a first switch of the second switching unit and one end of a second switch of the second switching unit are electrically connected to the first output end and another end of a first switch of the second switching unit and another end of a second switch of the second switching unit are electrically connected to the second sub-pixel of the first pixel directly;

wherein the first switch of the second switching unit and the second switch of the second switching unit are configured to simultaneously turn on or turn on only one to transmit the signal to the second sub-pixel of the first pixel;

wherein one end of a first switch of the third switching unit and one end of a second switch of the third switching unit are electrically connected to the first output end directly and another end of a first switch of the third switching unit and another end of a second switch of the third switching unit are electrically connected to the third sub-pixel of the first pixel directly; and wherein the first switch of the third switching unit and the second switch of the third switching unit are configured to simultaneously turn on or turn on only one to transmit the signal to the third sub-pixel of the first pixel.

10. The multiplexing circuit according to claim 9, wherein the first multiplexing unit further comprises a first control line of the second switching unit, a second control line of the second switching unit, a first control line of the third switching unit, and a second control line of the third switching unit;

wherein the first control line of the second switching unit is electrically connected to the first switch of the second switching unit directly to control the first switch of the second switching unit turning on or off;

wherein the second control line of the second switching unit is electrically connected to the second switch of the second switching unit directly to control the second switch of the second switching unit turning on or off;

wherein the first control line of the third switching unit is electrically connected to the first switch of the third switching unit directly to control the first switch of the third switching unit turning on or off; and wherein the second control line of the third switching unit is electrically connected to the second switch of the third switching unit directly to control the second switch of the third switching unit turning on or off.

11. The multiplexing circuit according to claim 10, wherein each of the first switching unit, the second switching unit, and the third switching unit further comprises a first selecting switch;

wherein one end of the first selecting switch of the first switching unit is electrically connected to the first control line of the first switching unit directly and another end of the first selecting switch of the first switching unit is electrically connected to the second switch of the first switching unit directly to control the second switch of the first switching unit turning on or off;

wherein one end of the first selecting switch of the second switching unit is electrically connected to the first control line of the second switching unit directly and another end of the first selecting switch of the second switching unit is electrically connected to the second switch of the second switching unit directly to control the second switch of the second switching unit turning on or off;

wherein one end of the first selecting switch of the third switching unit is electrically connected to the first control line of the third switching unit directly and another end of the first selecting switch of the third switching unit is electrically connected to the second switch of the third switching unit directly to control the second switch of the third switching unit turning on or off; and wherein the multiplexing circuit further comprises a first selecting signal line configured to control the first selecting switch of the first switching unit, the first selecting switch of the second switching unit, and the first selecting switch of the third switching unit turning on or off.

12. The multiplexing circuit according to claim 11, further comprising a second multiplexing unit configured to receive a signal at a second output end of the source driving circuit of the display and configured to transmit the signal to the pixel of the display;

wherein the second multiplexing unit comprises a first selecting switch and a first switching unit configured to control transmitting of the signal to a first sub-pixel of a second pixel of the display;

wherein the first switching unit of the second multiplexing unit comprises a first switch and a second switch;

wherein one end of the first switch of the second multiplexing unit and one end of the second switch of the second multiplexing unit are electrically connected to the second output end directly and another end of the first switch of the second multiplexing unit and another end of the second switch of the second multiplexing unit are electrically connected to the first sub-pixel of the second pixel directly;

wherein the first selecting switch of the second multiplexing unit is electrically connected to the second switch of the second multiplexing unit directly to control the second switch of the second multiplexing unit turning on or off.

13. The multiplexing circuit according to claim 11, further comprising a second multiplexing unit configured to receive a signal at a second output end of the source driving circuit of the display and configured to transmit the signal to the pixel of the display;

wherein the second multiplexing unit comprises a first switching unit configured to control transmitting of the signal to a first sub-pixel of a second pixel of the display;

wherein the first switching unit of the second multiplexing unit comprises a first switch and a second switch;

wherein one end of the first switch of the second multiplexing unit and one end of the second switch of the second multiplexing unit are electrically connected to the second output end directly and another end of the first switch of the second multiplexing unit and another end of the second switch of the second multiplexing unit are electrically connected to the first sub-pixel of the second pixel directly; and wherein the first selecting switch of the first multiplexing unit is electrically connected to the second switch of the second multiplexing unit directly to control the second switch of the second multiplexing unit turning on or off.

14. The multiplexing circuit according to claim 10, wherein the first switching unit further comprises a third switch;

wherein one end of the third switch of the first switching unit is electrically connected to the first output end directly and another end of the third switch of the first switching unit is electrically connected to the first sub-pixel of the first pixel directly;

wherein the first switch of the first switching unit, the second switch of the first switching unit, and the third switch of the first switching unit are configured to simultaneously turn on, turn on the first switch of the first switching unit and the second switch of the first switching unit only, or turn on the first switch of the first switching unit only to transmit the signal to the first sub-pixel of the first pixel;

wherein the second switching unit further comprises a third switch;

wherein one end of the third switch of the second switching unit is electrically connected to the first output end directly and another end of the third switch of the second switching unit is electrically connected to the second sub-pixel of the first pixel directly;

wherein the first switch of the second switching unit, the second switch of the second switching unit, and the third switch of the second switching unit are configured to simultaneously turn on, turn on the first switch of the second switching unit and the second switch of the second switching unit only, or turn on the first switch of the second switching unit only to transmit the signal to the second sub-pixel of the first pixel;

wherein the third switching unit further comprises a third switch;

wherein one end of the third switch of the third switching unit is electrically connected to the first output end directly and another end of the third switch of the third switching unit is electrically connected to the third sub-pixel of the first pixel directly;

wherein the first switch of the third switching unit, the second switch of the third switching unit, and the third switch of the third switching unit are configured to simultaneously turn on, turn on the first switch of the third switching unit and the second switch of the third switching unit only, or turn on the first switch of the third switching unit only to transmit the signal to the third sub-pixel of the first pixel.

15. The multiplexing circuit according to claim 14, wherein the first multiplexing unit further comprises:

a third control line of the first switching unit;

a third control line of the second switching unit; and a third control line of the third switching unit;

wherein the third control line of the first switching unit is electrically connected to the third switch of the first switching unit directly to control the third switch of the first switching unit turning on or off;

wherein the third control line of the second switching unit is electrically connected to the third switch of the second switching unit directly to control the third switch of the second switching unit turning on or off; and wherein the third control line of the third switching unit is electrically connected to the third switch of the third switching unit directly to control the third switch of the third switching unit turning on or off.

16. The multiplexing circuit according to claim 15, wherein the first multiplexing unit further comprises a first selecting switch and a second selecting switch;

wherein one end of the first selecting switch of the first switching unit is electrically connected to the first control line of the first switching unit directly and another end of the first selecting switch of the first switching unit is electrically connected to the second switch of the first switching unit directly to control the second switch of the first switching unit turning on or off;

wherein one end of the second selecting switch of the first switching unit is electrically connected to the first control line of the first switching unit directly and another end of the second selecting switch of the first switching unit is electrically connected to the third switch of the first switching unit directly to control the third switch of the first switching unit turning on or off;

wherein the second switching unit further comprises a first selecting switch and a second selecting switch;

wherein one end of the first selecting switch of the second switching unit is electrically connected to the first control line of the second switching unit directly and another end of the first selecting switch of the second switching unit is electrically connected to the second switch of the second switching unit directly to control the second switch of the second switching unit turning on or off;

wherein one end of the second selecting switch of the second switching unit is electrically connected to the first control line of the second switching unit directly and another end of the second selecting switch of the second switching unit is electrically connected to the third switch of the second switching unit directly to control the third switch of the second switching unit turning on or off;

wherein the third switching unit further comprises a first selecting switch and a second selecting switch;

wherein one end of the first selecting switch of the third switching unit is electrically connected to the first control line of the third switching unit directly and another end of the first selecting switch of the third switching unit is electrically connected to the second switch of the third switching unit directly to control the second switch of the third switching unit turning on or off;

wherein one end of the second selecting switch of the third switching unit is electrically connected to the first control line of the third switching unit directly and another end of the second selecting switch of the third switching unit is electrically connected to the third switch of the third switching unit directly to control the third switch of the third switching unit turning on or off;

wherein the multiplexing circuit further comprises a first selecting signal line and a second selecting signal line;

wherein the first selecting signal line is configured to control the first selecting switch of the first switching unit, the first selecting switch of the second switching unit, and the first selecting switch of the third switching unit turning on or off; and wherein the second selecting signal line is configured to control the second selecting switch of the first switching unit, the second selecting switch of the second switching unit, and the second selecting switch of the third switching unit turning on or off.

17. The multiplexing circuit according to claim 16, further comprises a second multiplexing unit configured to receive a signal at a second output end of the source driving circuit of the display and configured to transmit the signal to the pixel of the display;

wherein the second multiplexing unit comprises a first selecting switch, a second selecting switch, and a first switching unit configured to control transmitting of the signal to a first sub-pixel of a second pixel of the display;

wherein the first switching unit of the second multiplexing unit comprises a first switch, a second switch, and a third switch;

wherein all the first switch of the first switching unit of the second multiplexing unit, the second switch of the first switching unit of the second multiplexing unit, and the third switch of the first switching unit of the second multiplexing unit are electrically connected between the second output end directly and the first sub-pixel of the second pixel directly;

wherein the first selecting switch of the second multiplexing unit is electrically connected to the second switch of the second multiplexing unit directly to control the second switch of the second multiplexing unit turning on or off; and wherein the second selecting switch of the second multiplexing unit is electrically connected to the third switch of the second multiplexing unit directly to control the third switch of the second multiplexing unit turning on or off.

18. The multiplexing circuit according to claim 16, further comprising a second multiplexing unit configured to receive a signal at a second output end of the source driving circuit of the display and configured to transmit the signal to the pixel of the display;

wherein the second multiplexing unit comprises a first switching unit configured to control transmitting of the signal to a first sub-pixel of a second pixel of the display;

wherein the first switching unit of the second multiplexing unit comprises a first switch, a second switch, and a third switch;

wherein one end of the first switch of the first switching unit of the second multiplexing unit, one end of the second switch of the first switching unit of the second multiplexing unit, and one end of the third switch of the first switching unit of the second multiplexing unit are electrically connected to the second output end directly and another end of the first switch of the first switching unit of the second multiplexing unit, another end of the second switch of the first switching unit of the second multiplexing unit, and another end of the third switch of the first switching unit of the second multiplexing unit are electrically connected to the first sub-pixel of the second pixel directly;

wherein the first selecting switch of the first multiplexing unit is electrically connected to the second switch of the second multiplexing unit directly to control the second switch of the second multiplexing unit turning on or off; and wherein the second selecting switch of the first multiplexing unit is electrically connected to the third switch of the second multiplexing unit directly to control the third switch of the second multiplexing unit turning on or off.

* * * * *